US005708406A

United States Patent [19]

Tsunoda et al.

[11] Patent Number: 5,708,406

[45] Date of Patent: Jan. 13, 1998

[54] ROTARY ACTUATOR

[75] Inventors: Akira Tsunoda, Toyohashi; Hiroyuki Fujita, Hamamatsu, both of Japan

[73] Assignee: ASMO Co. Ltd., Shizuoka-ken, Japan

[21] Appl. No.: 591,034

[22] Filed: Jan. 25, 1996

[30] Foreign Application Priority Data

Mar. 20, 1995 [JP] Japan ..... 7-060978
Jun. 26, 1995 [JP] Japan ..... 7-159625

[51] Int. Cl.[6] ..... H01P 1/10; H01F 7/08

[52] U.S. Cl. ..... 335/272; 310/156; 310/254; 310/49 R

[58] Field of Search ..... 335/229–235, 335/272; 310/49 R, 152–156, 216–218, 254; 123/399

[56] References Cited

U.S. PATENT DOCUMENTS

| | | | |
|---|---|---|---|
| 1,929,787 | 10/1933 | Mudge | 310/218 |
| 3,021,444 | 2/1962 | Simmons et al. | 310/218 |
| 4,447,793 | 5/1984 | Gray | 333/106 |
| 5,275,141 | 1/1994 | Tsunoda et al. | 123/399 |

FOREIGN PATENT DOCUMENTS

| | | |
|---|---|---|
| 49838 | 2/1992 | Japan . |
| 28907 | 8/1993 | Japan . |
| 284671 | 10/1994 | Japan . |
| 292349 | 10/1994 | Japan . |

*Primary Examiner*—Michael L. Gellner
*Assistant Examiner*—Raymond Barrera
*Attorney, Agent, or Firm*—Sheridan Ross P.C.

[57] ABSTRACT

An improved rotary actuator having a reduced height is disclosed. The actuator has a stator core having excitable poles and yokes, a rotor with a rotor magnet, a bobbin frame having a rotor container and bobbin portions with excitable coils. The rotor container has a bore for receiving the rotor and magnet openings for receiving a pair of stator magnets. Each bobbin portion has a slot for receiving the excitable pole. The yokes are placed at the both sides of the bobbin. The rotor container has magnetic pole slots extending in an axial direction of the rotary magnet, each of which is open to the bore and communicates with the associated pole receiving slot of the bobbin portion. Magnetic pole pieces are mounted in the magnetic pole slots. Each magnetic pole piece has a surface facing the rotor magnet and another surface magnetically connected to the stator core.

33 Claims, 14 Drawing Sheets

ROTARY ACTUATOR

BACKGROUND OF THE INVENTION

1. Field of the Invention

The present invention relates to a rotary actuator provided with a reciprocating rotational rotor.

2. Description of the Related Art

Reciprocating rotary type actuators are often used to drive the rotary valves which control the intake timing in automobile engines. Unexamined Japanese Patent Publication No. 4-355651 discloses one conventional reciprocating rotary type actuator. This rotary actuator is smaller and less expensive to manufacture than typical reciprocating rotary type actuators. However, recent demand for higher-performance engines has fueled the demand for rotary actuators which are smaller, and still capable of producing at least as much rotational torque as the rotary actuator disclosed in Patent Publication No. 4-355651.

FIG. 1 is an exploded perspective view of a rotary actuator 70 disclosed in Patent Publication No. 4-355651. FIG. 2 is an exploded perspective view of a stator used in the rotary actuator 70. A description of the structure and the assembly process of the rotary actuator 70 follows.

A bobbin frame 71 has a pair of bobbin portions 72 formed integrally therewith to extend to opposite sides of the frame 71, a pair of openings 74 and a vertically extending borehole 76*a*. Excitation coils 73 are wound around the bobbin portions 72 of the frame 71. After winding the coils 73 around the bobbin portions 72, a rotor 76 with a rotor magnet 77 fitted around it is inserted into the borehole 76*a*. A pair of stator magnets 75 are respectively inserted in the openings 74, facing the rotor magnet 77.

Each E-shaped stator core half 78 has an excitable magnetic pole 79 and two yokes 81. The excitable magnetic pole 79 of each of the stator core halves 78 is inserted into an associated rectangular slot 80 formed in each bobbin portion 72. The distal end of each excitable magnetic pole 79 in the slot 80 faces the rotor magnet 77. When the yokes 81 of each stator core half 78 are placed on both sides of the associated bobbin portion 72, the distal ends of the facing yokes 81 abut each other, thus making magnetic connection between the stator core halves 78. The inner wall of the distal end of each yoke 81 contacts the outer wall of each stator magnet 75, to cause a magnetic connection. The two stator core halves 78 and the two stator magnets 75 constitute a four-pole stator.

When the density of magnetic flux in the magnetic field produced by the stator is constant and when the magnetic field penetrates the rotor magnet 77 along its axial direction, the rotary actuator produces a rotational torque proportional to the length of the rotor magnet 77 along its axial direction. In other words, the entire rotor magnet 77 contributes to the torque produced by the action of the magnetic field as long as the entire rotor magnet 77 is acted upon by the magnetic field. For this reason, the height of each stator core half 78 is defined to equal the length of the rotor magnet 77 in its axial direction in order to allow the magnetic field penetrating the magnetic pole 79 to influence the entire rotor magnet 77.

In order to reduce the height of the rotary actuator 70 in its axial direction, the height of the stator core halves 78, the bobbin portions 72 and the coils 73 wound around the bobbin portions 72 have to be reduced in the axial direction of the rotary actuator 70. Since the desired torque determines the diameter of each coil wire and the number of times the coil wire is wound, the amount by which the height of the coil 73 wound around the bobbin portion 72 can be reduced is limited unless the height of the bobbin portion 72 is shortened in the axial direction. With the height of each stator core half fixed, the height of the bobbin portion 72 is determined by its material properties so as to maintain the mechanical strength of the bobbin portions 72. As such, there is also a limitation on reducing the size of the bobbin portions 72 in the axial direction.

Therefore, in order to reduce the axial dimension or height of the rotary actuator 70, it is necessary to reduce the height of each of the stator core halves 78. When the height of each stator core half 78 is lower than the axial dimension of the rotor magnet 77, however, the magnetic field might not cover both the top and the bottom ends of the rotor magnet 77. This would prevent the magnetic energy of the magnetic field from being efficiently converted to rotational torque by the entire rotor magnet 77. Consequently, the torque generated by the rotary actuator would be insufficient for purposes such as driving rotational valves.

SUMMARY OF THE INVENTION

Broadly speaking, the present invention relates to a rotary actuator which can generate sufficient torque for purposes such as driving rotary valves while having an axial dimension which is smaller than those of conventional rotary actuators. The present invention further relates to a rotary actuator which has a smaller axial dimension than conventional rotary actuators and is easy to assemble.

A rotary actuator according to an embodiment of the invention includes: a stator magnet; a stator core having at least one excitable magnetic pole and a pair of yokes; a rotor provided with a rotor magnet; a bobbin frame having a rotor holder and a bobbin portion around which an excitable coil is wound. The rotor holder includes a bore for accommodating the rotor and a magnet opening in which the stator magnet is fitted to face the rotor magnet. The bobbin portion has a slot for accommodating the excitable magnetic pole such that the distal end of the excitable magnetic pole faces the rotor magnet. The pair of yokes of the stator core is placed on both sides of the bobbin portion in order to be in close proximity to the stator magnet.

The rotor holder further has a recess for the magnetic pole which is formed between the bore and the bobbin portion. This recess is open to the bore and extends in the axial direction of the rotary magnet. The recess for the magnetic pole also comes into contact with the slot formed in the bobbin portions. The rotary actuator further includes a magnetic pole piece fitted in the recess for the magnetic pole. One surface of the magnetic pole piece faces the rotor magnet along its axial direction while a second surface makes a magnetic connection with the excitable magnetic pole of the stator core.

According to the invention, it is possible to design the axial dimension or height of the stator core to be shorter than the axial length of the rotor magnet. Therefore, the height of the rotary actuator can be reduced.

Other aspects and advantages of the invention will become apparent from the following detailed description, taken in conjunction with the accompanying drawings, illustrating by way of example the principals of the invention.

BRIEF DESCRIPTION OF THE DRAWINGS

The present invention may best be understood by reference to the following description in conjunction with the accompanying drawings, in which.

DETAILED DESCRIPTION OF THE PREFERRED EMBODIMENTS

FIRST EMBODIMENT

Figure 1:
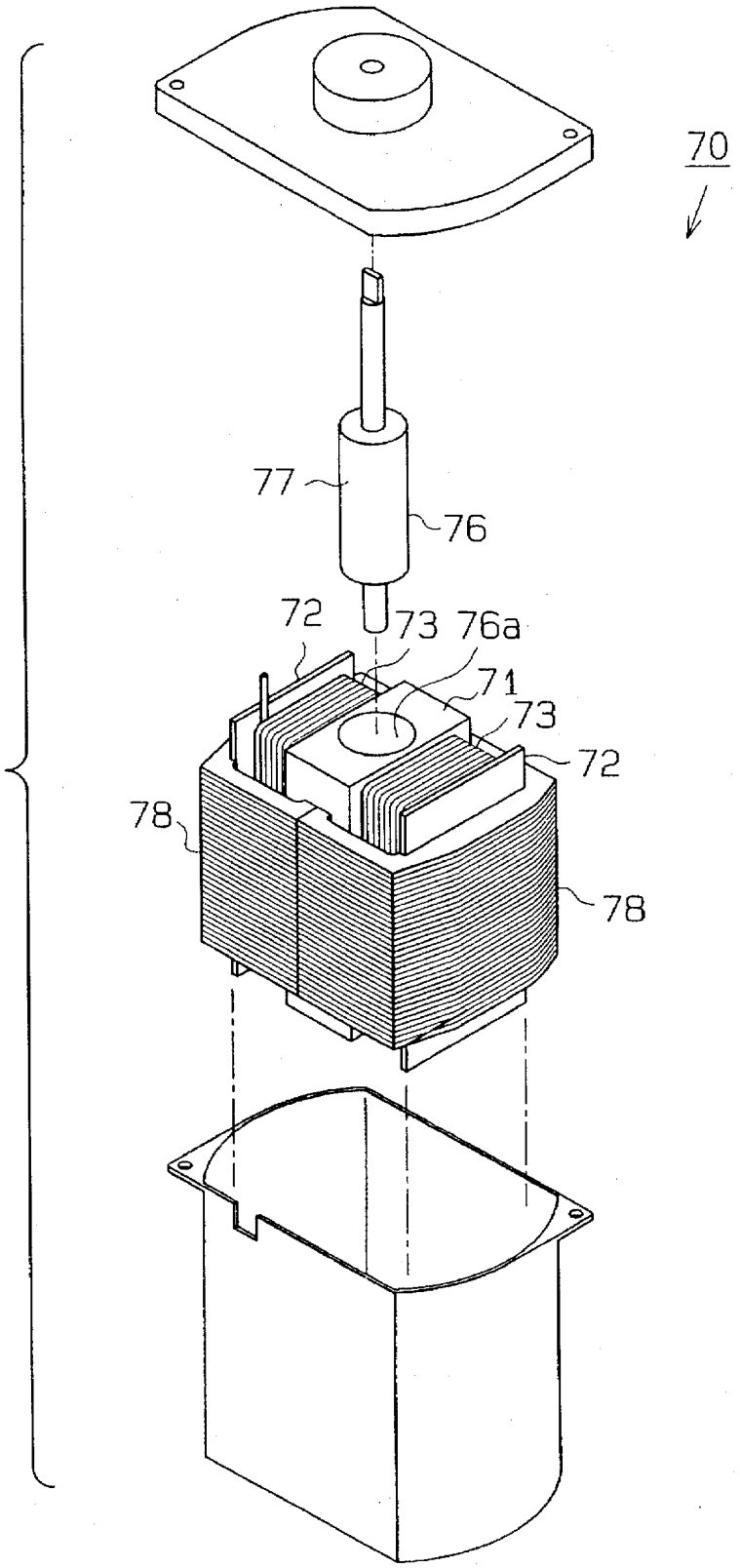
Fig.1 (Prior Art)
FIG. 1 is an exploded perspective view of a conventional rotary actuator.
Figure 2:
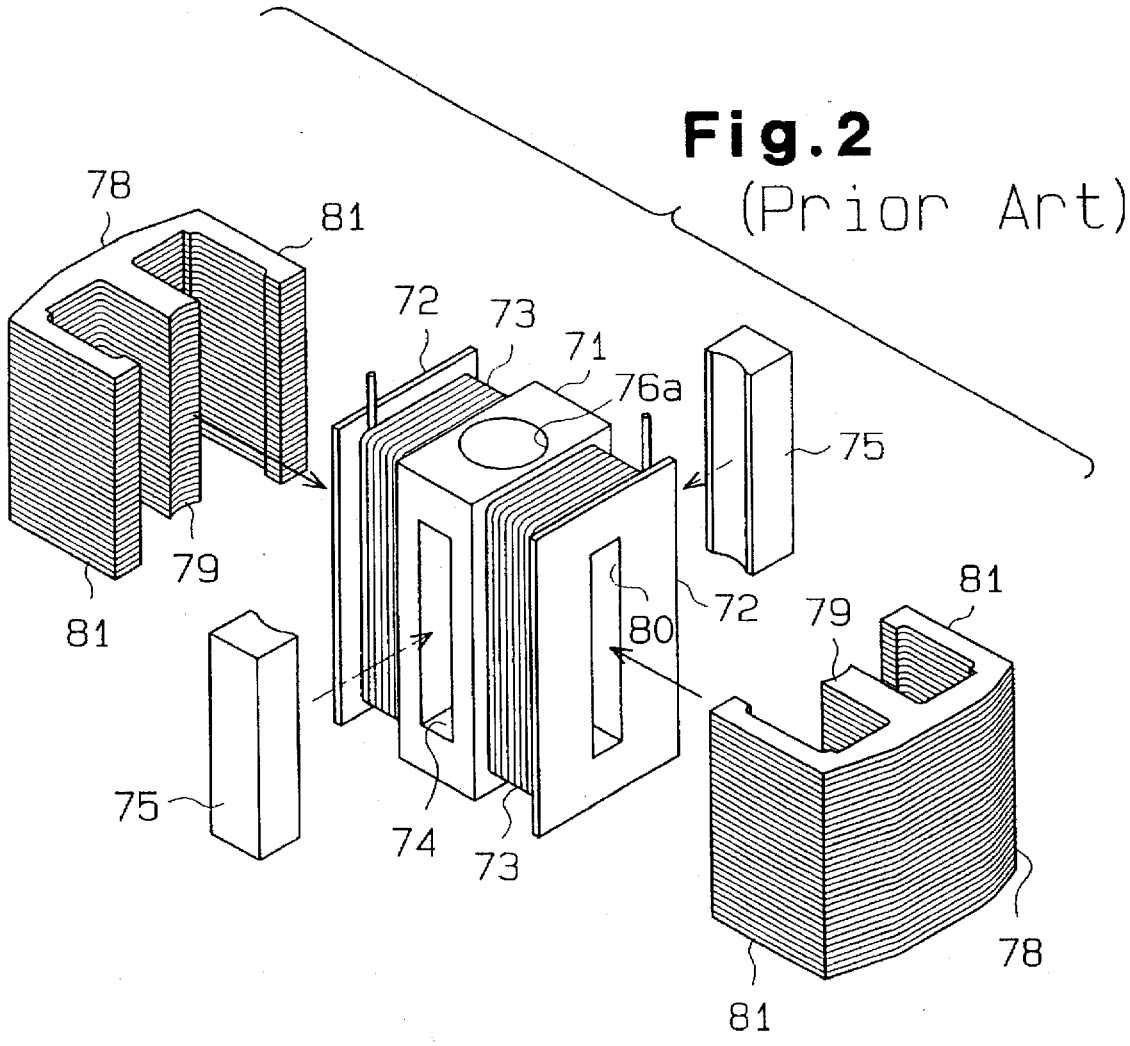
Fig.2 (Prior Art)
FIG. 2 is an exploded perspective view of a stator for the actuator shown in FIG. 1.
Figure 3:
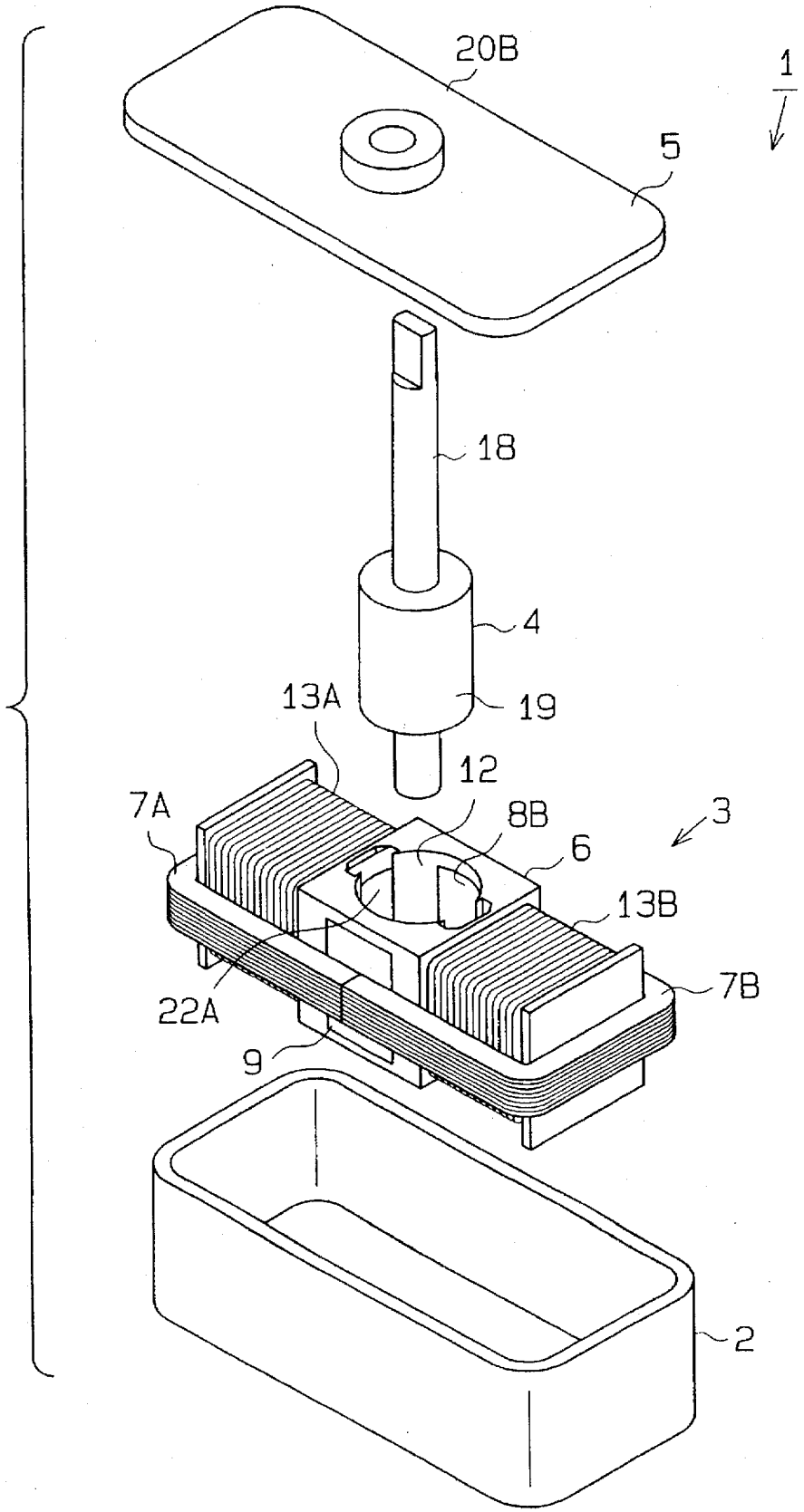
FIG. 3 is an exploded perspective view of a rotary actuator according to the present invention.

A rotary actuator according to a first embodiment of the present invention will now be described with reference to FIGS. 3 through 6. FIG. 3 shows a reciprocating rotary type actuator which comprises a casing 2, a stator 3, a rotor 4 and a cover 5. The stator 3 and the rotor 4 are housed in the casing 2, which has an open top that is sealed with the cover 5.

Figure 4:
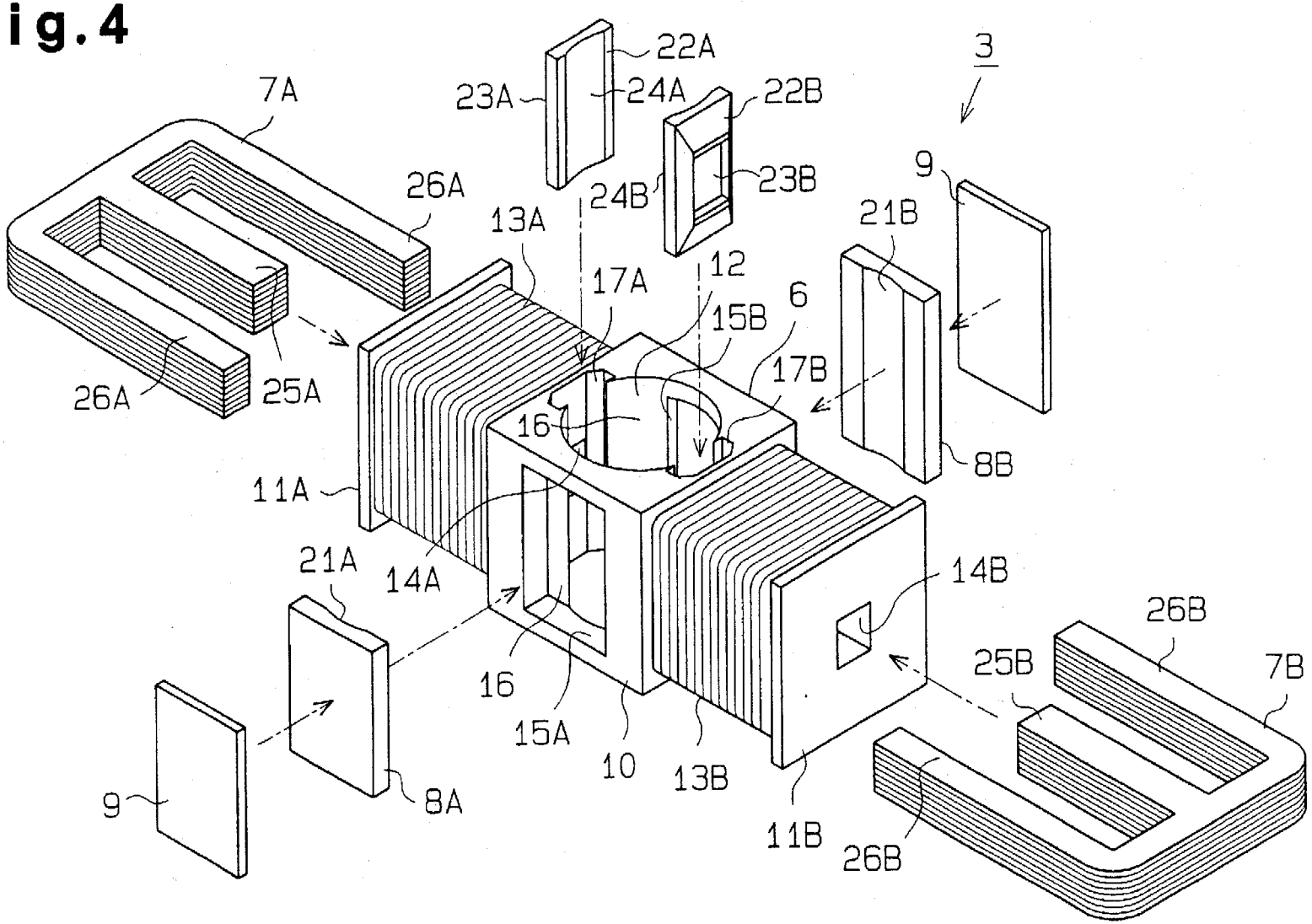
FIG. 4 is an exploded perspective view of a stator in accordance with a first embodiment of the invention.

As shown in FIG. 4, the stator 3 comprises a bobbin frame 6, two stator core halves 7A and 7B, stator magnets 8A and 8B and spacers 9. The frame 6 includes a rotor container 10, which takes the shape of a rectangular parallelepiped, and bobbin portions 11A and 11B which extend to opposite sides of the rotor container 10. The rotor container 10 has a bore 12 in which the rotor 4, as shown in FIG. 3, is contained. The bore 12 vertically penetrates the rotor container 10. An excitable coil 13A is wound around the left bobbin portion 11A and an excitable coil 13B is wound around the right bobbin portion 11B. The bobbin portions 11A and 11B have slots 14A and 14B, respectively, which penetrate from the outer wall of the bobbin portions 11A and 11B to the bore 12.

The rotor container 10 has magnet openings 15A and 15B which extend from the front and back walls of the rotor container 10 to the borehole 12. A pair of stoppers 16 are formed on the inner surfaces of the magnet openings 15A and 15B to define a border between the bore 12 and each magnet opening.

Furthermore, magnetic pole slots 17A and 17B extend vertically and serve as magnetic pole containers. The magnetic pole slots 17A and 17B are located on the inner wall of the bore 12 and are coupled with bobbin portions 11A and 11B, respectively. The magnetic pole slots 17A and 17B open into the bore 12. The bore 12 comes into contact with slots 14A and 14B of the bobbin portions 11A and 11B via the magnetic pole slots 17A and 17B. The width of the openings of the slots 17A and 17B to the bore 12 is smaller than the maximum width of the magnetic pole slots 17A and 17B.

Figure 5:
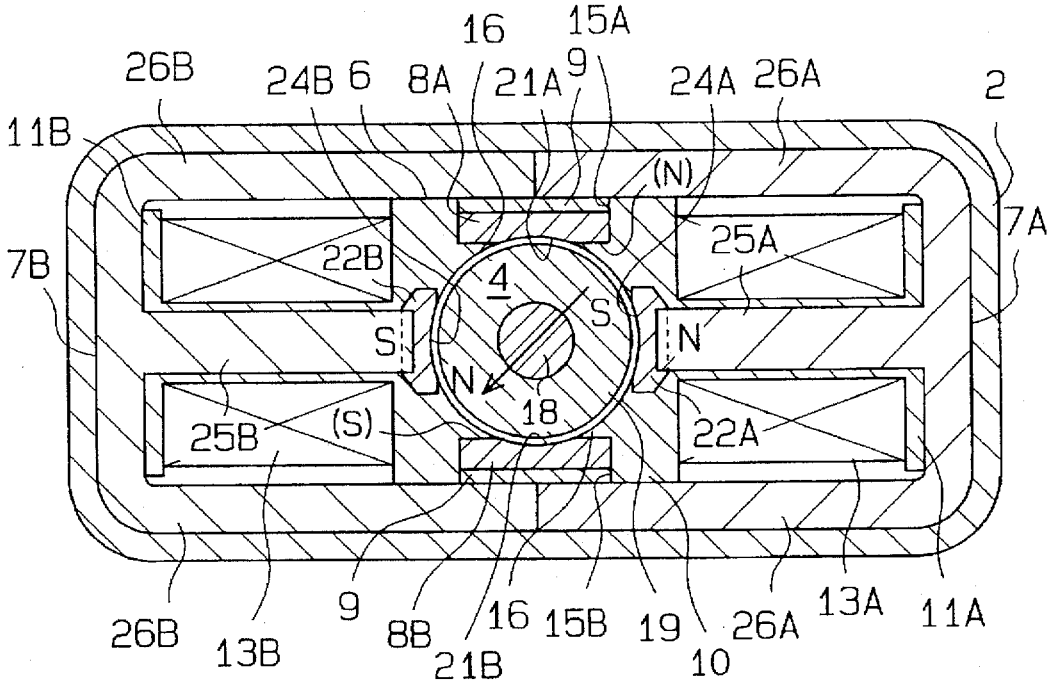
FIG. 5 is a horizontal sectional view of the rotary actuator of the first embodiment.
Figure 6:
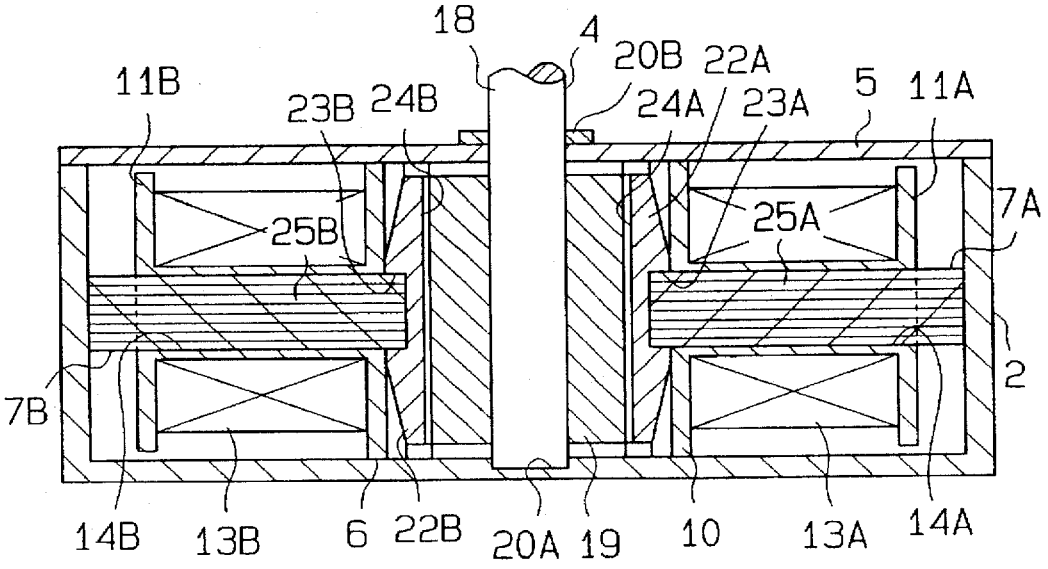
FIG. 6 is a vertical longitudinal sectional view of the rotary actuator of the first embodiment.

The rotor 4, as shown in FIG. 3, is free to rotate in the bore 12. As shown in FIGS. 3 and 5, the rotor 4 includes a rotor shaft 18 and a cylindrical rotor magnet 19 fitted around the rotary shaft 18. One side along the radial axis of the magnet 19 is magnetized to an "N" pole, while the opposite side is magnetized to an "S" pole. The lower end of the rotor shaft 18 abuts against a shaft bearing 20A formed on the bottom of the casing 2 as shown in FIG. 6. The upper end of the rotary shaft 18 protrudes from a shaft bearing 20B formed on the cover 5.

As shown in FIGS. 5 and 6, the stator magnets 8A and 8B are fitted in the magnet openings 15A and 15B, respectively. The stator magnets 8A and 8B have active surfaces 21A and 21B facing the bore 12. The curvature of the active surfaces 21A and 21B are made to match the curvature of the inner surface of the bore 12. The stoppers 16 prevent the associated stator magnets 8A and 8B from entering into the bore 12. When the stator magnets 8A and 8B are fitted in the magnet openings 15A and 15B, respectively, the active surfaces 21A and 21B of the stator magnets 8A and 8B, respectively, face the inner wall of the bore 12. In the first embodiment, the active surface 21A of the stator magnet 8A is magnetized to an "N" pole and the active surface 21B of the stator magnet 8B is magnetized to an "S" pole. In the magnet openings 15A and 15B, the spacers 9 are placed behind the stator magnets 8A and 8B, respectively.

Magnetic pole pieces 22A and 22B are fitted in the magnetic pole slots 17A and 17B, respectively. The magnetic pole piece 22A has a recess 23A on the outside surface (in this embodiment, the outside surface is the surface facing an excitable magnetic pole 25A) and an active surface 24A on the inside surface (in this embodiment, the inner surface is on the side of the bore 12). The excitable magnetic pole 25A is plugged into the recess 23A. The curvature of the active surface 24A matches the curvature of the inner surface of the bore 12. On the inner wall of the magnetic pole piece 22A, the peripheral portion of the magnetic pole piece 22A which is adjacent to the curved active surface is made flat. The length of the active surface 24A in the vertical direction (in this embodiment, the vertical direction is in the axial direction of the rotor 4) is equal to the length of the rotor magnet 19. The magnetic pole piece 22B fitted in the magnetic pole slot 17B also has a recess 23B and an active surface 24B, as in the case of the magnetic pole piece 22A.

The stator core halves 7A and 7B are formed by a plurality of laminated E-shaped magnetic plates. The stator core half 7A includes a center arm serving as an excitable magnetic pole 25A, while two side arms serve as yokes 26A. The excitable magnetic pole 25A is inserted in the slot 14A of the bobbin portion 11A in such a manner that its distal end is plugged into the recess 23A of the magnetic pole piece 22A, thereby fixing the magnetic pole piece 22A in the magnetic pole slot 17A. The yokes 26A of the stator core half 7A are placed one on each side of the bobbin portion 11A. Similarly, the excitable magnetic pole 25B of the stator core half 7B is inserted in the slot 14B of the bobbin portion 11B in such a manner that its distal end is plugged into the recess 23B of the magnetic pole piece 22B, thereby fixing the magnetic pole piece 22B in the magnetic pole slot 17B. The yokes 26B of the stator core half 7B are placed one on each side of the bobbin portion 11B.

The ends of the yokes 26A of the stator core half 7A make contact with the ends of the yokes 26B of the stator core half 7B approximately in the middle of the spacers 9 in the magnet openings 15A and 15B. The stator core halves 7A and 7B form a magnetic flux path on the side of the stator 3. Accordingly, the excitable magnetic poles 25A and 25B and the stator magnets 8A and 8B are magnetically connected via the yokes 26A and 26B to form a four pole stator. Electric current passes through the excitable coils 13A and 13B and excites the excitable magnetic poles 25A and 25B in order to magnetize them to different poles. In other words, when the excitable magnetic pole 25A is set to an "N" pole, the magnetic pole 25B is set to an "S" pole, or when the excitable magnetic pole 25A is set to an "S" pole, the magnetic pole 25B is set to the "N" pole.

The operation of the rotary actuator 1 according to the first embodiment will now be described. As shown in FIG. 5, electric current passes through the excitable coils 13A and 13B and magnetizes the excitable magnetic pole 25A to an pole and the excitable magnetic pole 25B to an "S" pole. This causes the "S" pole of the rotor magnet 19 to be attracted by the excitable magnetic pole 25A as an "N" pole and the active surface 21A as an "N" pole, of the stator magnet 8A, while the "N" pole of the rotor magnet 19 is attracted by the excitable magnetic pole 25B as an "S" pole and the active surface 21B as an "S" pole of the stator magnet 8B. Consequently, the rotor 4 is kept stationary at a position where the "S" pole of the rotor magnet 19 is located between the excitable magnetic pole 25A and the active surface 21A, and where the "N" pole of the rotor magnet 19 is located between the excitable magnetic pole 25B and the active surface 21B.

Subsequently, the direction of the electric current is reversed, and the excitable magnetic pole 25A is set to an "S" pole and the excitable magnetic pole 25B is set to an pole. This causes, the "N" pole of the rotor magnet 19 to be attracted by the excitable magnetic pole 25A as an "S" pole and the active surface 21B as an "S" pole of the stator magnet 8B, while the "S" pole of the rotor magnet 19 is attracted by the excitable magnetic pole 25B as an "N" pole and the active surface 21A as an "N" pole of the stator magnet 8A. Consequently, the rotor 4 rotates counterclockwise by 90 degrees from the location shown in FIG. 5, to be relocated to a position where the "N" pole of the rotor magnet 19 is located between the excitable magnetic pole 25A and the active surface 21B, and to a position where the "S" pole of the rotor magnet 19 is located between the excitable magnetic pole 25B and the active surface 21A.

The reversal of the direction of the electric current sets the excitable magnetic pole 25A to an "N" pole and the excitable magnetic pole 25B to an "S" pole. The rotor 4 then rotates clockwise by 90 degrees to be relocated to a position where the "S" pole of the rotor magnet 19 is located between the excitable magnetic pole 25A and the active surface 21A of the stator magnet 8A, and to a position where the pole of the rotor magnet 19 is located between the excitable magnetic pole 25B and the active surface 21B of the stator magnet 8B. As described above, the rotor 4 can be reciprocating or swing driven by 90 degrees in accordance with the controlled direction of the electric current.

When the excitable magnetic poles 25A and 25B are excited by the passage of electric current through the excitable coils 13A and 13B, either the magnetic flux of the excitable magnetic poles 25A and 25B penetrates the magnetic pole pieces 22A and 22B and the rotor magnet 19, or the magnetic flux in the rotor magnet 19 reaches the excitable magnetic poles 25A and 25B by passing through magnetic pole pieces 22A and 22B as magnetic flux guides. Since the axial height of the active surfaces 24A and 24B of the magnetic pole pieces 22A and 22B, respectively, is approximately equal to the length of the rotor magnet 19 in the axial direction, the magnetic flux penetrating the excitable magnetic poles 25A and 25B, guided by the magnetic pole pieces 22A and 22B, influences the entire rotor magnet 19 in its axial direction. This allows the energy of the magnetic flux penetrating the excitable magnetic poles 25A and 25B to be efficiently converted into a rotational torque by the rotor magnet 19.

As described above, according to the rotary actuator 1 of the first embodiment, the heights of the stator core halves 7A and 7B is less than the length of the rotor magnet 19 in its axial direction, and the magnetic pole pieces 22A and 22B are connected to the distal ends of the excitable magnetic poles 25A and 25B, respectively. Additionally, the axial lengths of the active surfaces 24A and 24B of the magnetic pole pieces 22A and 22B, respectively, are equal to the axial length of the rotor magnet 19. As a result, the magnetic flux penetrating the excitable magnetic poles 25A and 25B is guided through the entire rotor magnet 19 via the magnetic pole pieces 22A and 22B. Therefore, the entire rotor magnet 19 contributes to generating a rotational torque of rotation based on the magnetic field. The rotary actuator according to the first embodiment generates a designed or desired torque despite the fact that the height of the stator core halves 7A and 7B is smaller. In other words, in order to reduce the height of the actuator, the axial dimensions of the excitable coils 13A and 13B must be made smaller. This can be achieved with the present invention without reducing the generated torque.

SECOND EMBODIMENT

A rotary actuator according to a second embodiment of the present invention will now be described with reference to FIGS. 7 to 10. The second embodiment is substantially the same as the first embodiment with the notable exception that the magnetic pole pieces 22A and 22B in the first embodiment are replaced with different magnetic pole pieces 30A and 30B, respectively. To avoid a redundant description, the components which have already been described in the first embodiment will not be described again. Only a detailed explanation of the new magnetic pole pieces 30A and 30B will be given herein.

Figure 7:
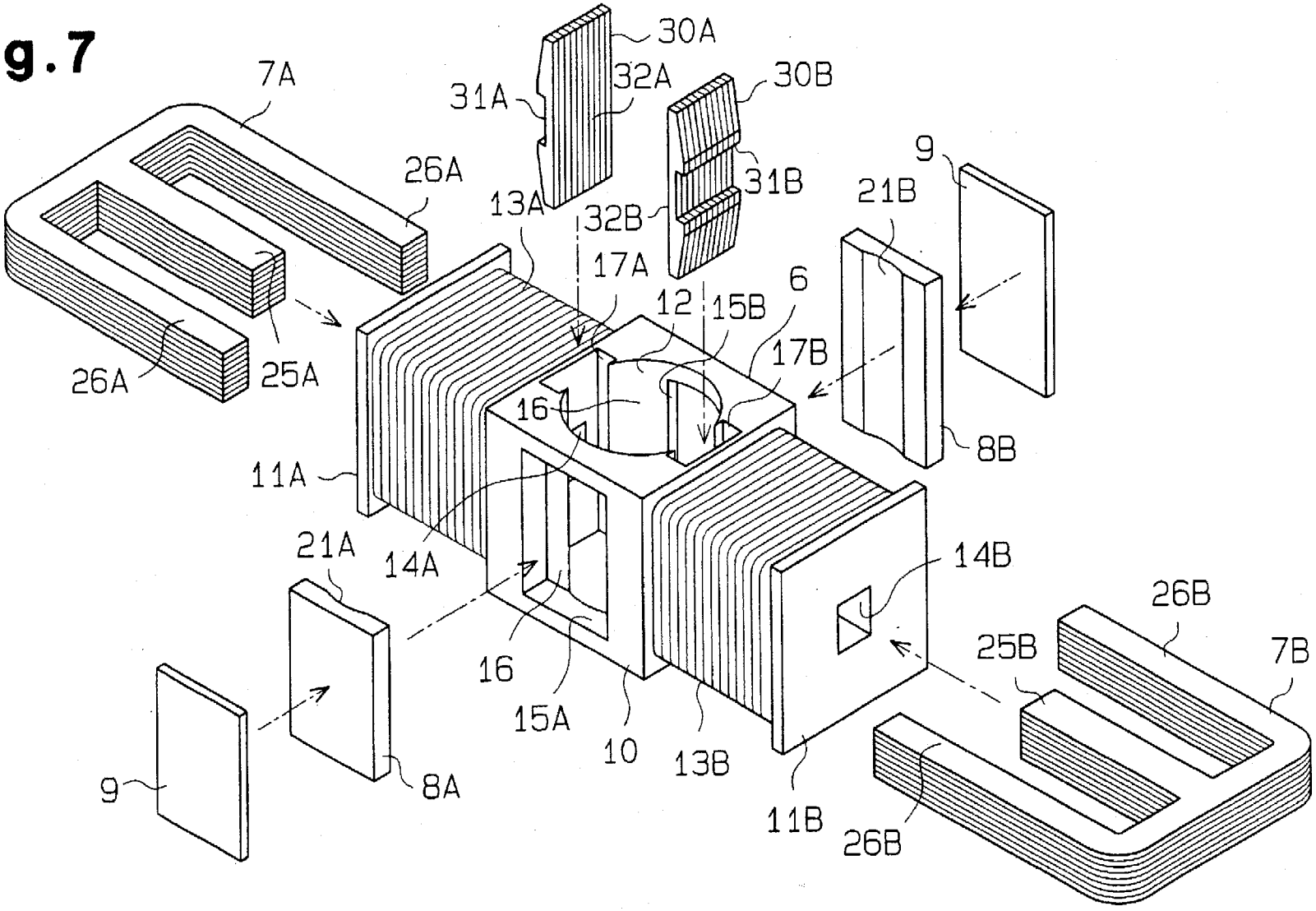
FIG. 7 is an exploded perspective view of a stator in accordance with a second embodiment of the present invention.

As shown in FIG. 7, the magnetic pole pieces 30A and 30B are formed by horizontally laminating a plurality of thin magnetic plates. Specifically, the direction in which the thin magnetic plates are laminated to form each magnetic pole piece 30A or 30B is orthogonal to the direction in which a plurality of thin stator core magnetic plates are laminated to form each stator core half 7A or 7B. The magnetic pole pieces 30A and 30B have grooves 31A and 31B formed on their outer walls, respectively. Each of the grooves 31A and 31B extends in the direction in which the thin magnetic plates are laminated to form the magnetic pole pieces 30A or 30B, respectively. The grooves 31A and 31B can be engaged with the distal ends of the excitable magnetic poles 25A and 25B, respectively. The magnetic pole pieces 30A and 30B have flat active surfaces 32A and 32B, respectively, on their inner walls (in this embodiment, the inner walls are the surfaces facing the rotor 4) respectively. The axial lengths or heights of the magnetic pole pieces 30A and 30B are equal to the axial length of the rotor magnet 19.

Figure 8:
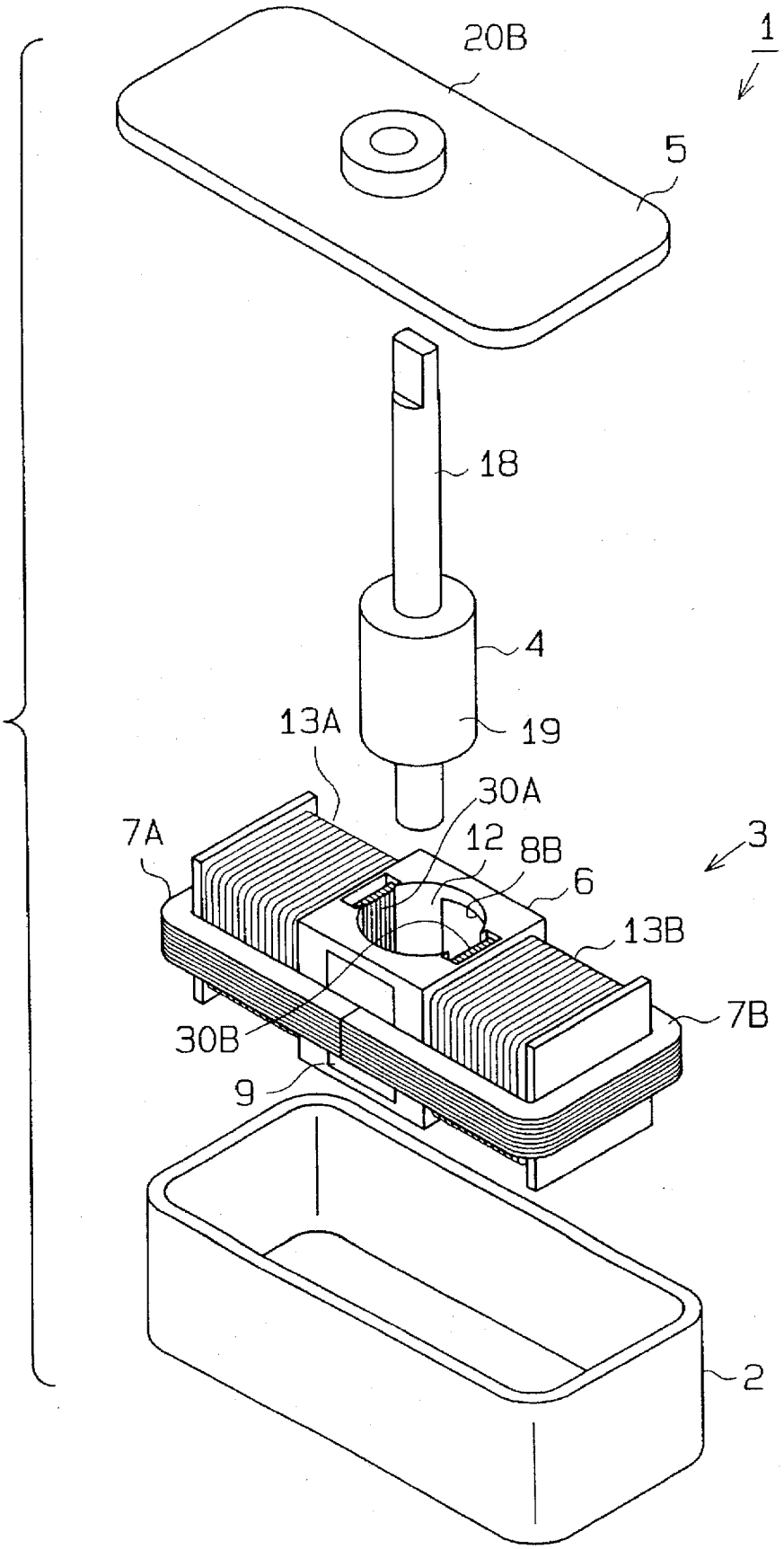
FIG. 8 is an exploded perspective view of the rotary actuator of the second embodiment.
Figure 9:
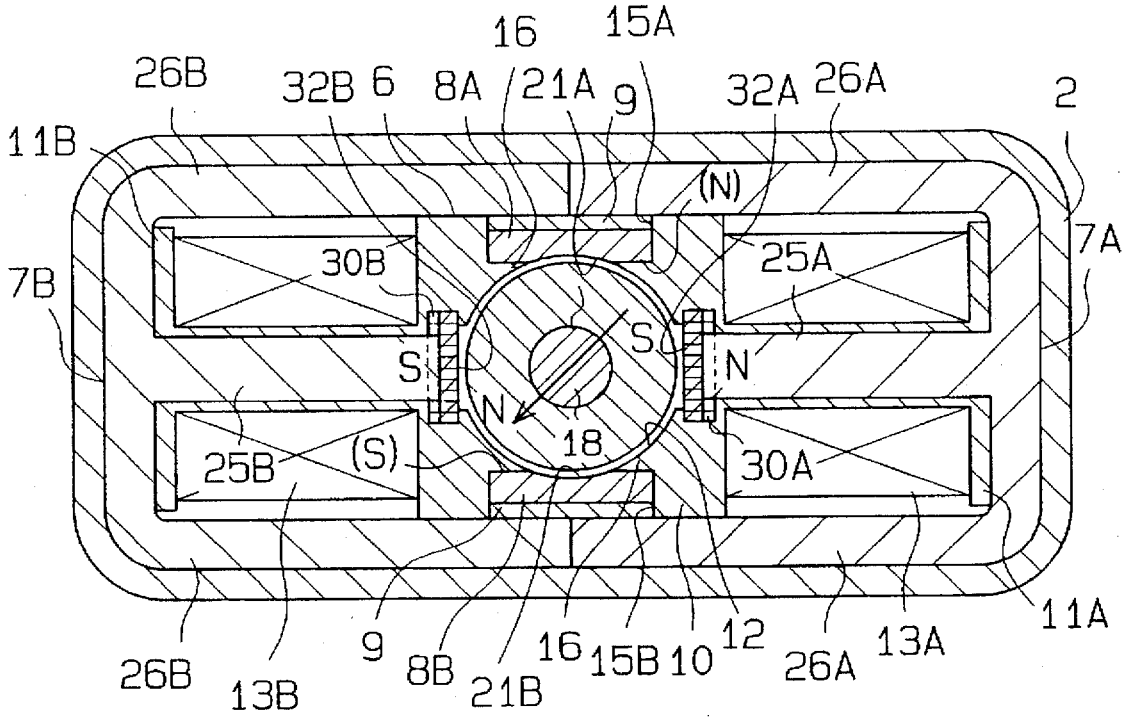
FIG. 9 is a horizontal sectional view of the rotary actuator of the second embodiment.
Figure 10:
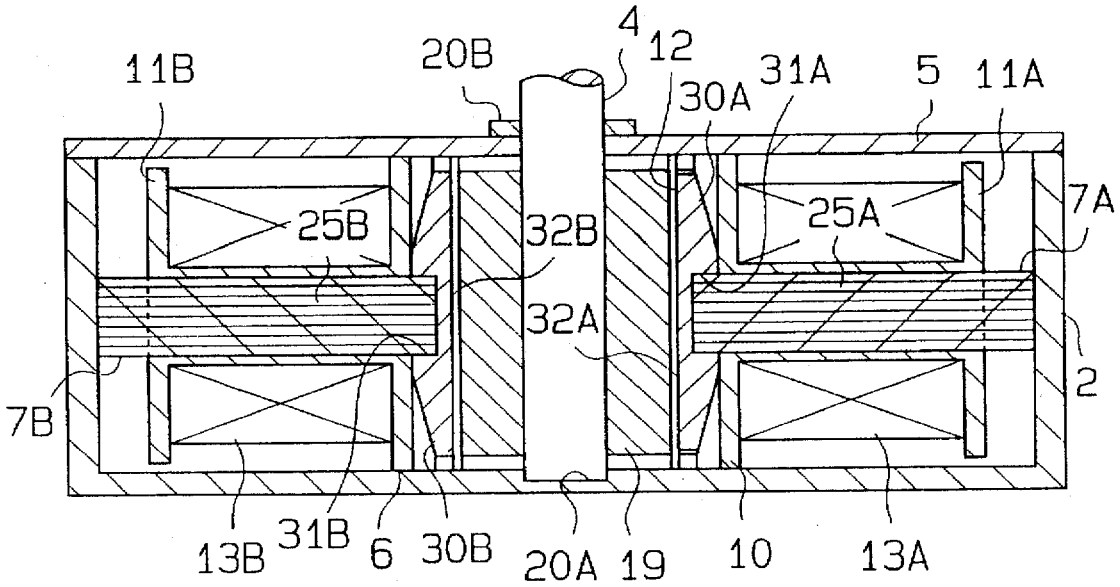
FIG. 10 is a vertical longitudinal sectional view of the rotary actuator of the second embodiment.

As shown in the FIGS. 8, 9 and 10, the end of the excitable magnetic pole 25A is engaged with the groove 31A of the magnetic pole piece 30A mounted in the magnetic pole slot 17A. The mid-section with respect to the width of the active surface 32A of the magnetic pole piece 30A constitutes a portion of the inner wall of the bore 12. The engagement between the end of the excitable magnetic pole 25A and the groove 31A causes the magnetic pole piece 30A to be fixed at a position where the magnetic pole piece 30A faces the rotor 4. Similarly, the end of the excitable magnetic pole 25B is engaged with the groove 31B of the magnetic pole piece 30B mounted in the magnetic pole slot 17B. The mid-section with respect to the width of the active surface 32B of the magnetic pole piece 30B constitutes a portion of the inner wall of the bore 12. The engagement between the end of the excitable magnetic pole 25B and the groove 31B causes the magnetic pole piece 30B to be fixed at a position where the magnetic pole piece 30B faces the rotor 4.

In the rotary actuator according to the second embodiment, the distal ends of the excitable magnetic poles 25A and 25B of the stator core halves 7A and 7B produced from laminated magnetic plates, are magnetically connected to the magnetic pole pieces 30A and 30B, respectively, which are also produced from laminated magnetic plates. This reduces the energy loss due to eddy currents which may be generated in the stator core halves 7A and 7B and the magnetic pole pieces 30A and 30B.

The rotary actuator of the second embodiment therefore has the following advantages in addition to the common advantages shared with the rotary actuator of the first embodiment.

Forming both the stator core halves 7A and 7B and the magnetic pole pieces 30A and 30B with laminated thin magnetic plates reduces and restricts the loss of energy due to eddy currents in the stator core halves 7A and 7B and in the magnetic pole pieces 30A and 30B. This improves the response of the rotary actuator, and in particular, the response of the actuator when it is operated at a high-speed.

The magnetic pole pieces 30A and 30B formed with horizontally laminated magnetic plates are connected to the distal ends of the stator core halves 7A and 7B formed with vertically laminated magnetic plates. The structure of this connection as explained above prevents the plates forming the magnetic pole pieces 30A and 30B from falling out of the magnetic pole slots 17A and 17B, respectively.

THIRD EMBODIMENT

A rotary actuator according to a third embodiment of the present invention will now be described with reference to FIG. 11 to FIGS. 16A and 16B. The third embodiment is substantially the same as the second embodiment with the following four notable exceptions: 1) the magnetic pole pieces 30A and 30B in the second embodiment are replaced with different magnetic pole pieces 40A and 40B; 2) a spacer 45 is placed around the rotor shaft 18; 3) a spacer pit 43 is formed on the top surface of the rotor container 10; and 4) magnetic pole supporters 44A and 44B are included at the bottom of the magnetic pole slots 17A and 17B, respectively. To avoid redundant descriptions, descriptions relating to components which have already been described in either the first or second embodiments will be omitted. Only detailed explanations of the magnetic pole pieces 40A and 40B, the spacer 45, the spacer pit 43 and the magnetic pole supporters 44A and 44B will be given herein.

Figure 11:
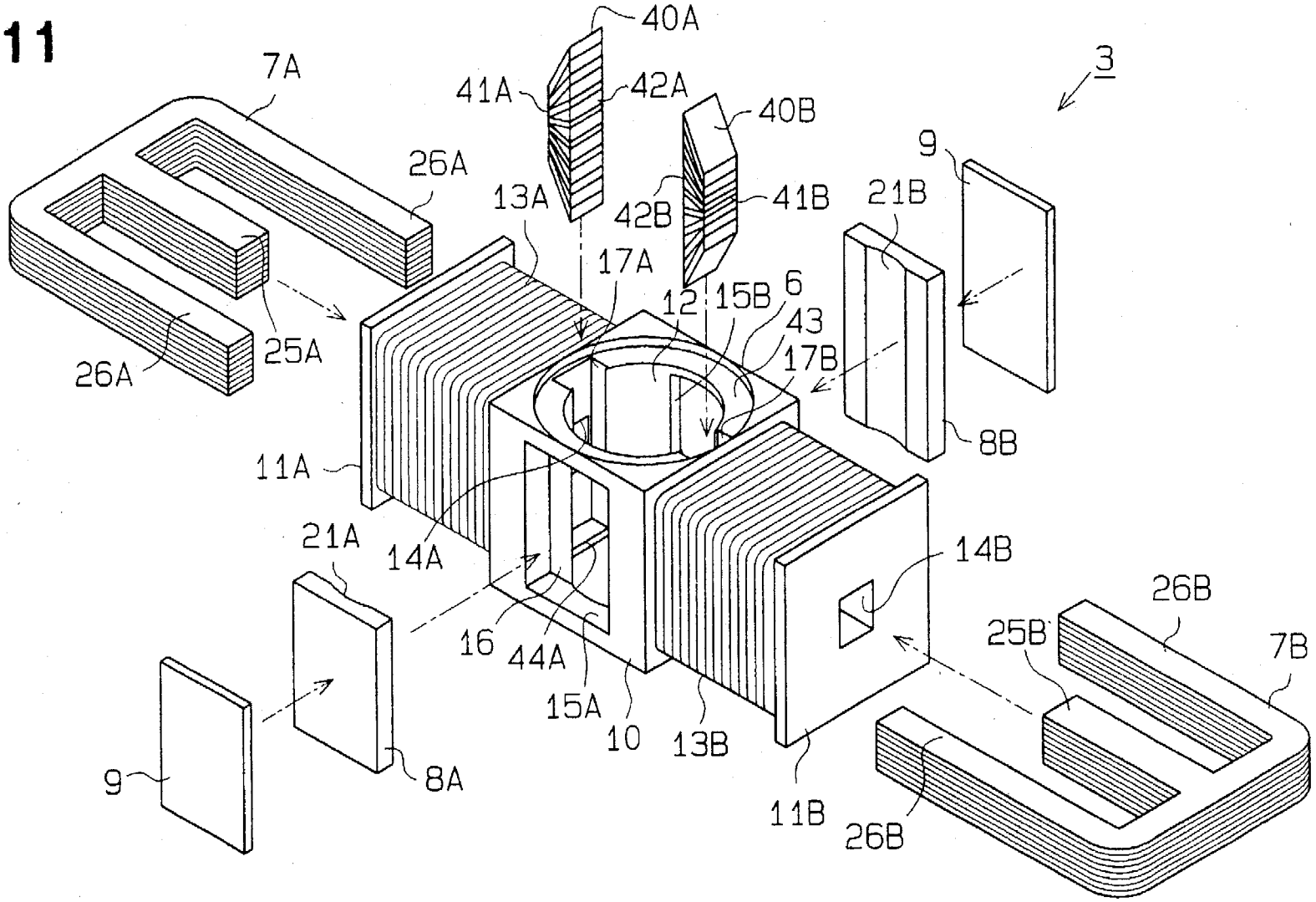
FIG. 11 is an exploded perspective view of a stator in accordance with a third embodiment of the present invention.

As shown in FIG. 11, the magnetic pole piece 40A is formed from a plurality of small, thin magnetic plates laminated in the axial direction. The laminated magnetic plates contact one another at only one end of each plate, while the opposite ends of the plates are spread out so that the side view of the magnetic pole piece 40A takes the shape of a trapezoid, or a fan. The outer ends of the magnetic plates of the magnetic pole piece 40A form a base surface 41A of the piece 40A and the inner ends of the magnetic plates form an active surface 42A of the piece 40A. Each of the magnetic plates of the magnetic pole piece 40A has the same thickness as that of the associated magnetic plate forming the excitable magnetic pole 25A, and the number of the magnetic plates forming the magnetic pole piece 40A is equal to the number of the magnetic plates forming the excitable magnetic pole 25A. The base surface 41A of the magnetic pole piece 40A is in contact with the distal end of the magnetic pole 25A. The active surface 42A of the magnetic pole piece 40A is flat and its width is equal to the width of the distal end of the magnetic pole 25A. The axial length or height of the active surface 42A is equal to the height of the rotor magnet 19. The magnetic pole piece 40B also has a base surface 41B and an active surface 42B, which correspond to the base and active surfaces 41A and 42A of the piece 40A.

The circular spacer pit 43 is formed on the top of the rotor container 10. (The inner diameter of the spacer pit 43 slightly greater than the distance between two inner walls of the magnetic pole slots 17A and 17B, which face each other.

Magnetic pole supporters 44A and 44B are provided on the inner walls of the rotor container 10 at the bottoms of the magnetic pole slots 17A and 17B, respectively. The magnetic pole supporters 44A and 44B close the openings at the bottoms of the associated magnetic pole slots 17A and 17B.

Figure 12:
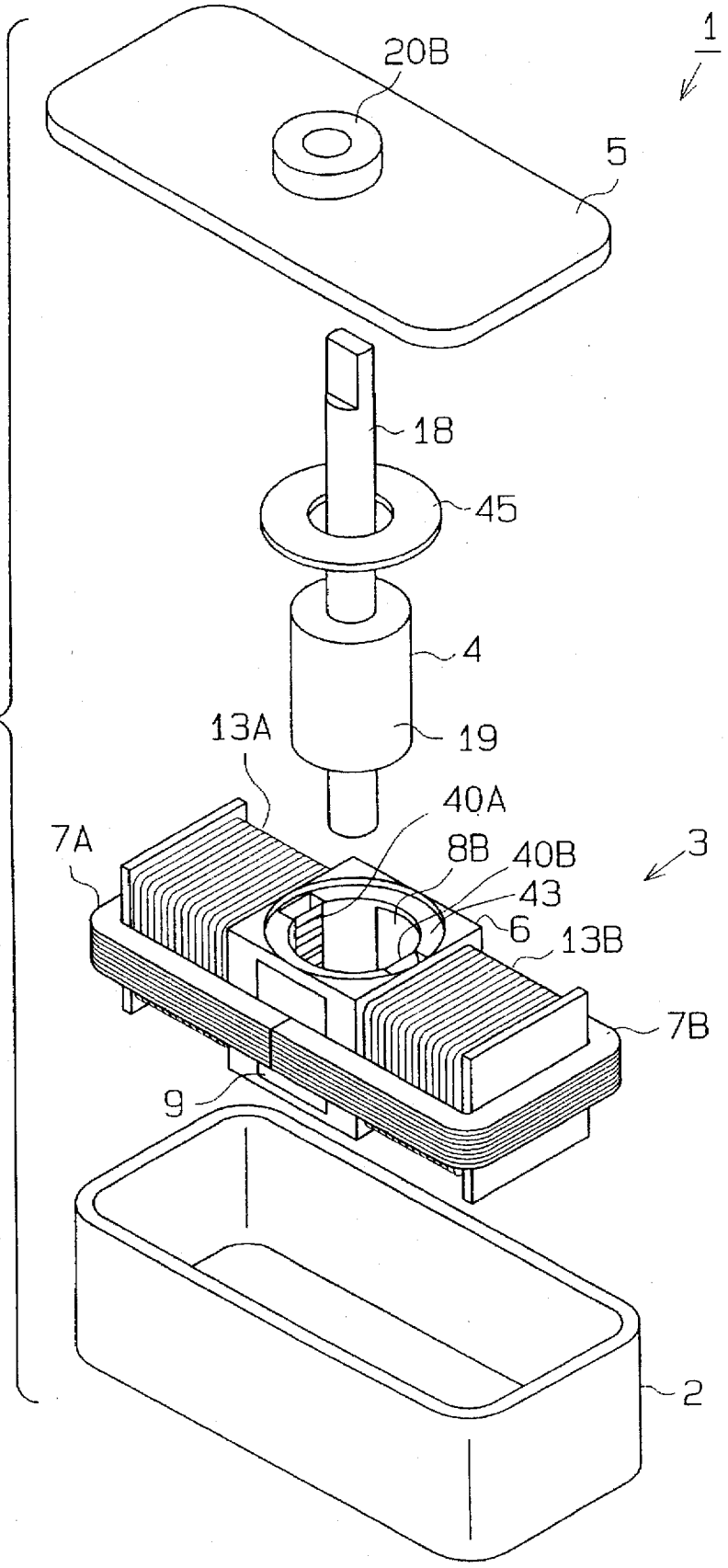
FIG. 12 is an exploded perspective view of the rotary actuator of the third embodiment.
Figure 14:
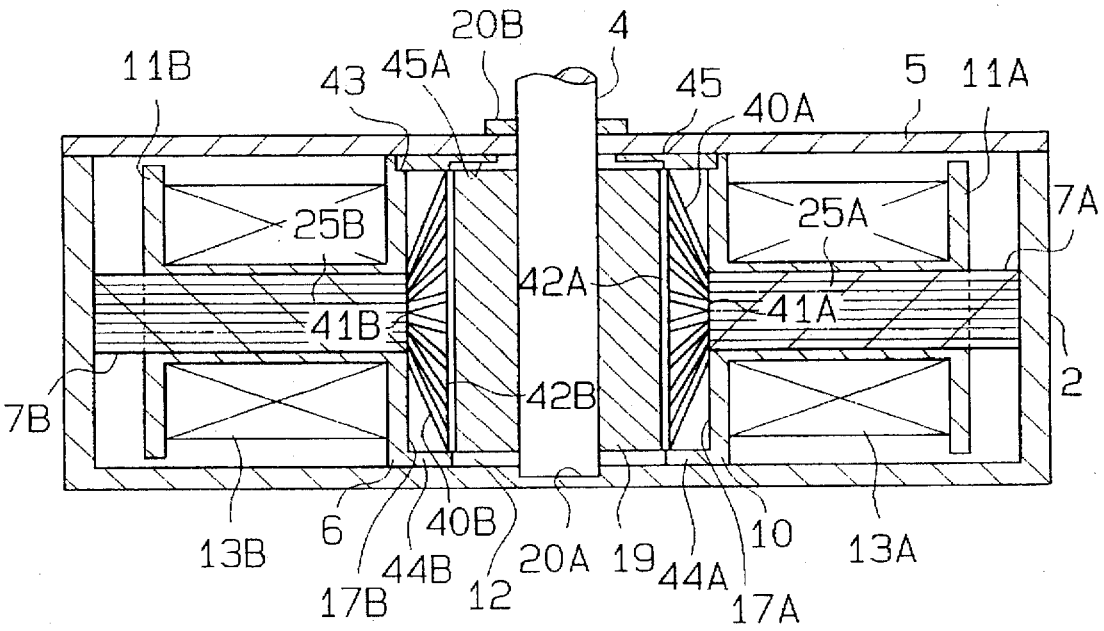
FIG. 14 is a vertical longitudinal sectional view of the rotary actuator of the third embodiment.

As shown in FIG. 12, a flat dougnut shaped spacer 45 is placed around the rotor shaft 18 above the rotor magnet 19. The spacer 45 is small enough to be retained in the spacer pit 43. As shown in FIG. 14, the spacer 45 has a cylindrical clearance cavity 45A formed on its bottom surface. The diameter of the clearance cavity 45A is slightly larger than that of the bore 12.

Figure 13:
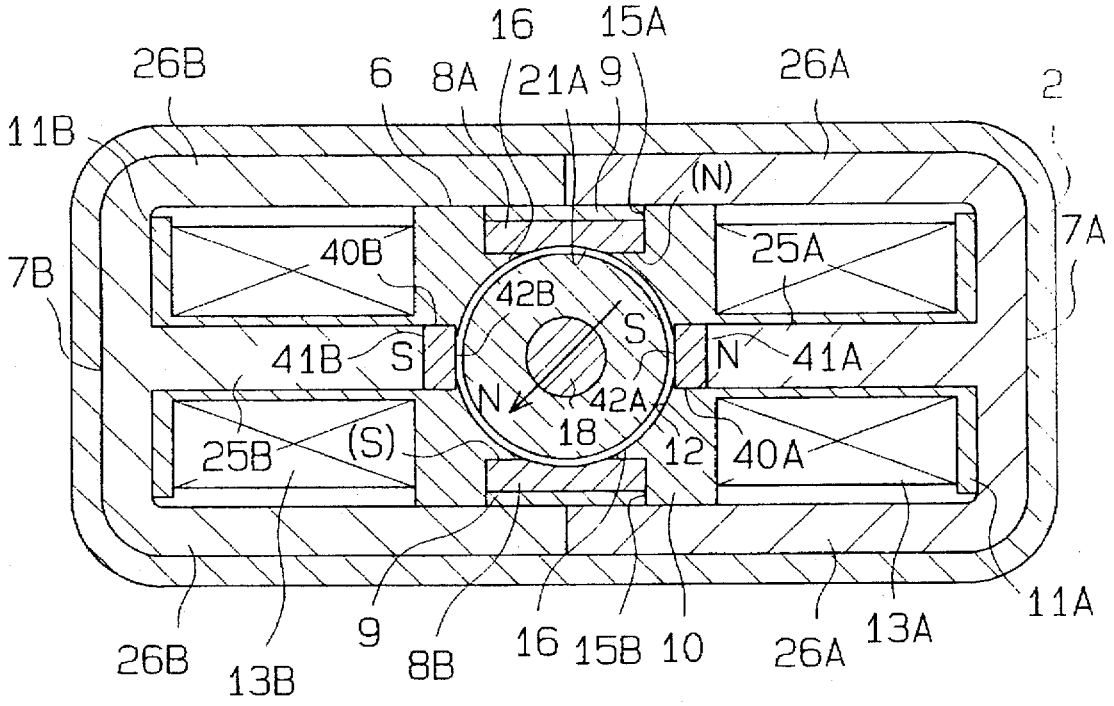
FIG. 13 is a horizontal sectional view of the rotary actuator of the third embodiment.

As shown in FIGS. 13 and 14, the magnetic pole piece 40A is retained in the magnetic pole slot 17A, with the bottom end of the magnetic pole piece 40A touching the magnetic pole supporter 44A and the top end of the magnetic pole piece 40A touching the bottom surface of the spacer 45 fitted in the spacer pit 43, outside the clearance cavity 45A. The distal end of the excitable magnetic pole 25A abuts to the base surface 41A of the magnetic pole piece 40A. Additionally, each of the magnetic plates of the magnetic pole piece 40A touches the associated magnetic plate of the excitable magnetic pole 25A. Each magnetic plate of the excitable magnetic pole 25A, together with the associated magnetic plate of the magnetic pole piece 40A, forms a magnetic flux path. The active surface 42A of the magnetic pole piece 40A, which closes the opening of the magnetic pole slot 17A to the borehole 12, faces the outer surface of the rotor magnet 19.

Likewise, the magnetic pole piece 40B is retained in the magnetic pole slot 17B between the magnetic pole supporter 44B and the spacer 45. The end of the excitable magnetic pole 25B touches the base surface 41B of the magnetic pole piece 40B. Further, each of the magnetic plates of the magnetic pole piece 40B touches the associated magnetic plate of the excitable magnetic pole 25B. The active surface 42B of the magnetic pole piece 40B faces the outer surface of the rotor magnet 19.

Figure 15:
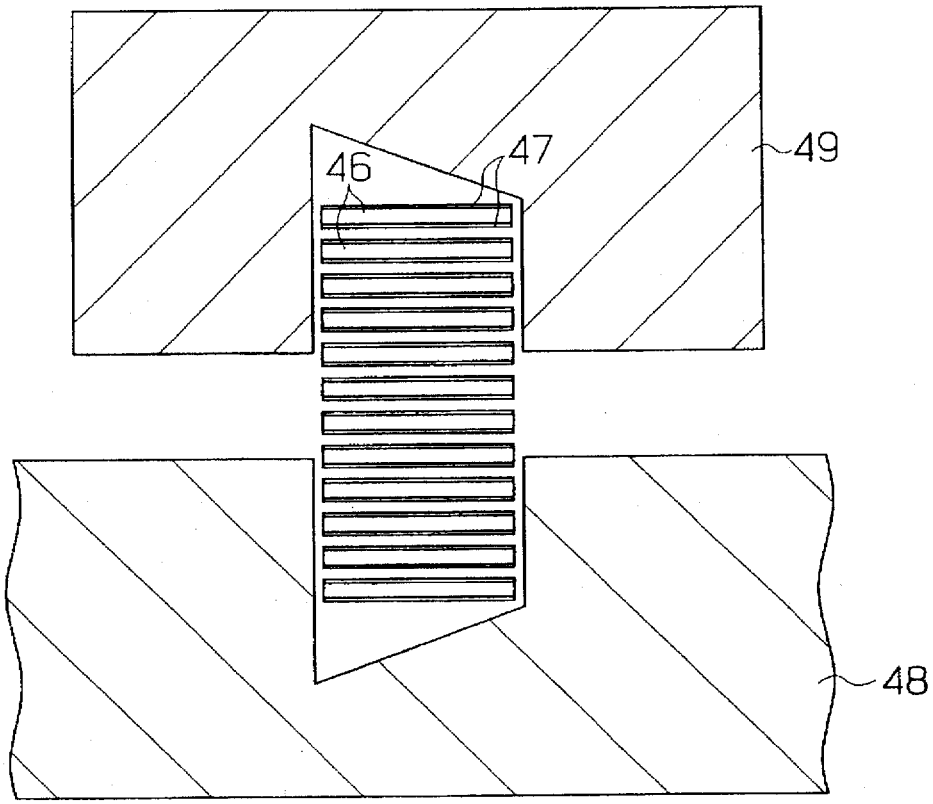
FIG. 15 is a diagram which portrays part of the manufacturing process of a magnetic pole piece.

The process of manufacturing the magnetic pole pieces 40A and 40B will now be described. As shown in FIG. 15, a coating of synthetic resin such as a polyamide resin, an example of which is Nylon (trade name), is applied to the top and bottom surfaces of each of a plurality of magnetic plates 46 which forms the magnetic pole piece 40A or 40B. A plurality of the magnetic plates 46, whose number is equal to that of the magnetic plates forming each of the stator core halves 7A and 7B, are vertically stacked and then placed between a lower fixed mold 48 and an upper movable mold 49. The fixed mold 48 has a cavity with an inner bottom surface which is sloped and is the deepest at the left end and the shallowest at the right end. The movable mold 49 has a cavity with an upper surface which is sloped and is highest at the left end and lowest at the right end. Accordingly, the airtight cavity formed by the fixed and movable molds 48 and 49 has a trapezoidal shape.

Figure 16A:
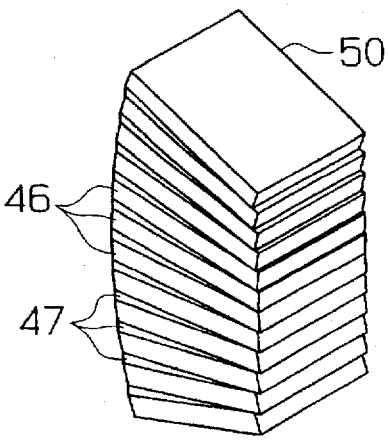
FIG. 16A is a perspective view of an unfinished magnetic pole piece immediately after being assembled.
Figure 16B:
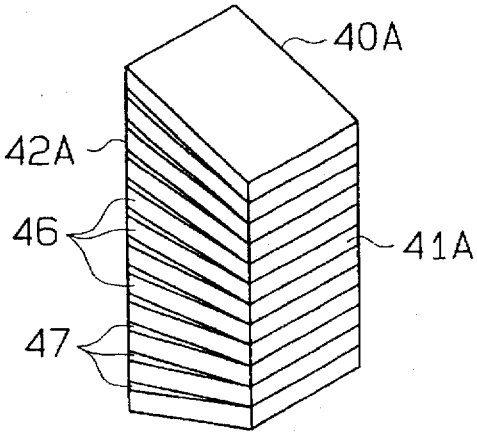
FIG. 16B is a perspective view of a finished magnetic pole piece after a cutting process.

The laminated magnetic plates 46 are pressed by moving the movable mold 49 toward the fixed mold Simultaneously, the two molds 48 and 49 are heated to fluidize the synthetic resin 47 coated over each of the magnetic plates 46. The pressure applied to the right ends of the plates 46 is greater than the pressure applied to the left ends. The fluidized synthetic resin 47 therefore flows from the right to the left of each magnetic plate 46. The right ends of the magnetic plates 46 are brought closer and the distances between the respective left ends are made wider. In addition, the melting synthetic resin 47 fills the spaces at the left ends of the magnetic plates 46. Consequently, as shown in FIG. 16A, the magnetic plates 46 are rearranged in a sectorial form with their right ends stuck together. A cooling process hardens the synthetic resin 47, thus creating an unfinished magnetic pole piece 50. By cutting the left and right ends of the unfinished magnetic pole piece 50, a magnetic pole piece 40A having a flat base surface 41A and a flat action surface 42A is obtained as shown in FIG. 16B.

In the rotary actuator according to the third embodiment, the magnetic pole piece 40A is fixed at a predetermined position in the magnetic pole slot 17A by the magnetic pole supporter 44A and the spacer 45. The inclusion of the magnetic pole supporter 44A and the spacer 45 facilitates the mounting of the magnetic pole piece 40A in the magnetic pole slot 17A. Likewise, the magnet pole piece 40B is fixed at the predetermined position in the magnetic pole slot 17B by the magnetic pole supporter 44B and the spacer 45.

With the magnetic pole piece 40A retained in the magnetic pole slot 17A, the base surface 41A abuts against the distal end surface of the excitable magnetic pole 25A. Consequently, the magnetic pole piece 40A is magnetically connected to the excitable magnetic pole 25A. The magnetic plates forming the magnetic pole piece 40A and the associated magnetic plates of the excitable magnetic pole 25A form continuous magnetic flux paths. These magnetic flux paths are guided toward the entire rotor magnet 19 in its axial direction, by means of the magnetic pole piece 40A, which is spread sectorially. Similarly, the magnetic flux paths, each formed by each of the magnetic plates forming the magnetic pole piece 40B and the associated magnetic plate in the excitable magnetic pole 25B, are guided toward the entire rotor magnet 19 in its axial direction, by means of the magnetic pole piece 40B. Accordingly, the magnetic flux or magnetic field, which penetrates the magnetic pole piece 40A and the magnetic pole 25A, or the magnetic pole piece 40B and the magnetic pole 25B, is more stable than the magnetic flux or magnetic field of the second embodiment which uses the magnetic pole pieces 30A and 30B. Furthermore, the magnetic pole pieces 40A and 40B of the third embodiment reduce the magnetic reluctance in the magnetic flux path formed by the magnetic pole piece 40A and the magnetic pole 25A and in the magnetic flux path formed by the magnetic pole piece 40B and the magnetic pole 25B. Consequently, the magnetic reluctance in all the magnetic paths of the stator is reduced.

The rotary actuator of the third embodiment has the following advantages in addition to the advantages of the second embodiment.

Adopting the magnetic pole piece 40A and 40B having the above-mentioned structure further stabilizes the magnetic flux or magnetic field, at the magnetic flux paths formed through the magnetic pole piece 40A and the magnetic pole 25A and through the magnetic pole piece 40B and the magnetic pole 25B. This reduces the loss of energy due to eddy currents, and improves the response of the rotary actuator. The reduction of the magnetic reluctance at the magnetic flux paths in the stator allows the rotary actuator to generate a greater torque.

The magnetic pole pieces 40A and 40B, described with reference to FIGS. 15, 16A and 16B, have no recesses corresponding to the grooves 31A and 31B of the magnetic pole pieces 30A and 30B in the second embodiment. Therefore, the magnetic pole pieces 40A and 40B can be manufactured through a cutting process consisting of a fewer number of treatment steps.

Although only three embodiments of the present invention have been described herein, it should be apparent to those skilled in the art that the present invention may be embodied in many other specific forms without departing from the spirit or scope of the present invention. Particularly, it should be understood that the present invention may be embodied in the following forms.

Each of the stator core halves 7A and 7B in the first, second and third embodiments can be formed by a single piece of magnetic material.

The yokes 26A and 26B of the stator core halves 7A and 7B and the stator magnets 8A and 8B may be in direct contact, without placing the spacers 9 therebetween.

In the above-mentioned first, second and third embodiments, the number of the magnetic plates forming the stator core halves 7A and 7B may be changed. In the second embodiment, the number of the magnetic plates forming the magnetic pole pieces 30A and 30B may be changed as needed. Further, in the third embodiment, the number of magnetic plates forming magnetic pole pieces 40A and 40B may be different from the number of the magnetic plates forming the stator core halves 7A and 7B.

Figure 17A:
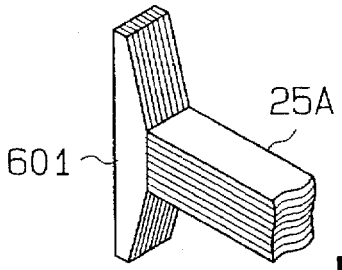
FIGS. 17A, 17B and 17C are perspective views of modifications of magnetic pole pieces.
Figure 17B:
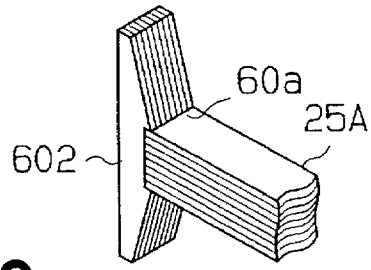
Figure 17C:
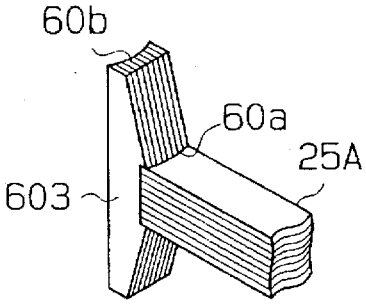

The magnetic pole pieces 30A and 30B of the second embodiment may be replaced with the magnetic pole pieces illustrated in FIGS. 17A to 17C and 18A to 18B. As shown in FIGS. 17A to 17C, the width of each of magnetic pole pieces 601, 602 and 603 along the direction in which magnetic plates are stacked is equal to the width of the excitable magnetic pole 25A or 25B. FIG. 17A illustrates the magnetic pole piece 601 having no recess which can be engaged with the excitable magnetic pole 25A. FIG. 17B illustrates the magnetic pole piece 602 having a recess **60*a*** which can be engaged with the excitable magnetic pole 25A. FIG. 17C illustrates the magnetic pole piece 603 having an active surface **60*b* with a curvature which matches that of the inner wall of the bore 12**.

Figure 18A:
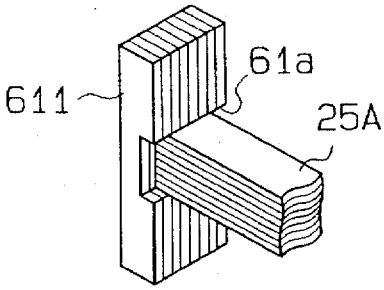
FIGS. 18A, 18B and 18C are perspective views of modifications of magnetic pole pieces.
Figure 18B:
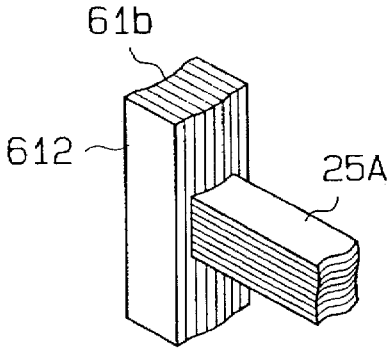
Figure 18C:
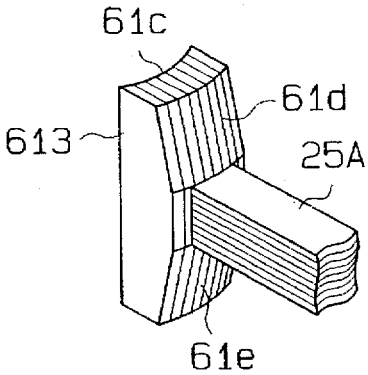

As shown in FIGS. 18A to 18C, the width of each of magnetic pole pieces 611, 612 and 613 along the direction in which the magnetic plates are stacked is greater than the width of the excitable magnetic poles 25A or 25B. FIG. 18A illustrates the magnetic pole piece 611 which has an engaging recess **61*a* and is shaped like a rectangular parallelepiped. FIG. 18B illustrates the magnetic pole piece 612 which has a curved active surface 61*b* at the center thereof in the plane of its width. The curved active surface 61*b* has a curvature matching that of the inner wall of the bore 12. FIG. 18C illustrates the magnetic pole piece 613 having a curved action surface 61*c*. The entire active surface 61*c* has a curvature matching the curvature of the inner wall of the bore 12. The magnetic pole piece 613 also has tilting surfaces 61*d* and 61*e* above and below the excitable magnetic pole 25A**.

In the first and second embodiments, magnetic pole supporters may be provided at the bottoms of the magnetic pole slots 17A and 17B. The magnetic pole supporters allow the magnetic pole pieces 22A and 22B (30A and 30B) to be retained at predetermined positions in the magnetic pole slots 17A and 17B, facilitating the mounting process of the magnetic pole pieces 22A and 22B (30A and 30B) to the stator.

Figure 19A:
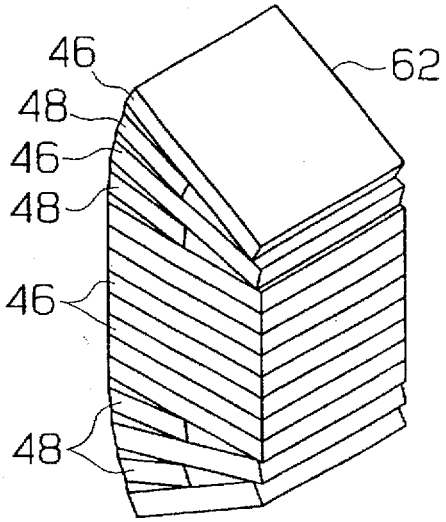
FIG. 19A is a perspective view of an unfinished magnetic pole piece immediately after being assembled.
Figure 19B:
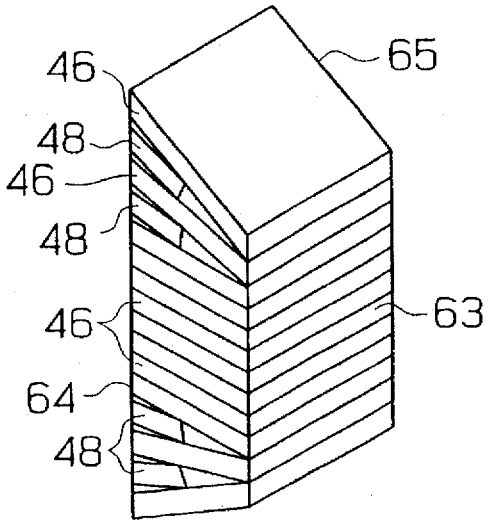
FIG. 19B is a perspective view of a finished magnetic pole piece after a cutting process.

The magnetic pole pieces 40A and 40B in the third embodiment can each be replaced with a magnetic pole piece 65 shown in FIG. 19B. FIG. 19A illustrates an unfinished magnetic pole piece 62 from which the magnetic pole piece 65 is formed. The unfinished magnetic pole piece 62 has a central portion formed by a plurality of the magnetic plates 46 and upper and lower portions formed by a plurality of long and short magnetic plates 46 and 48 which are alternately laminated. The magnetic plates 48 are shorter than the long magnetic plates 46. Each of the magnetic plates 48 is placed between the magnetic plates 46 with one end flush with the action surface so that the unfinished magnetic piece 62 is sectorially shaped. The unfinished magnetic pole piece 62 is subjected to a cutting process to obtain a magnetic pole piece 65 having a flat active surface 64 and a flat base surface 63.

Figure 20:
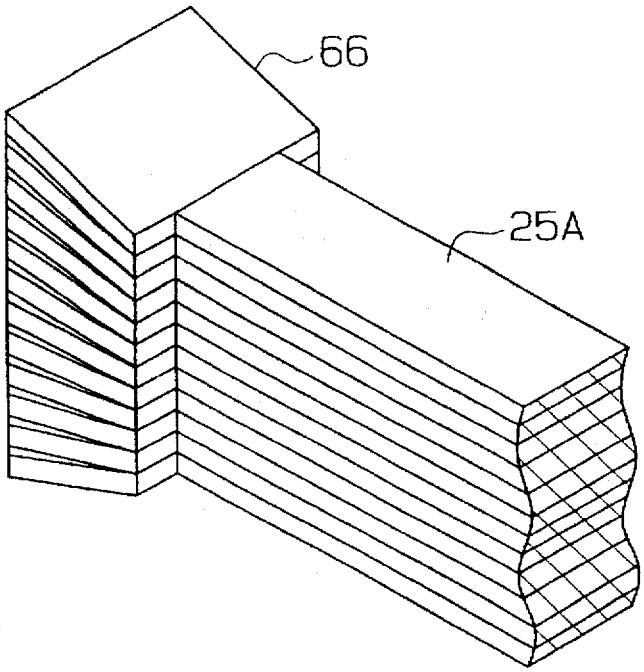
FIG. 20 a perspective view of a modified magnetic pole piece.

Each of the magnetic pole pieces 40A and 40B in the third embodiment may be replaced with a magnetic pole piece 66 shown in FIG. 20, whose width is wider than that of the excitable magnetic pole 25A.

In the first, second and third embodiments, each of the magnetic pole slots 17A and 17B can have an opening adjacent to one of the magnetic openings 15A and 15B on the side wall of the rotor container 10, in order to insert the magnetic pole pieces 22A and 22B (30A and 30B, 40A and 40B) from the sides of the rotor container 10 into the slots 17A and 17B, respectively.

In the first, second and third embodiments, each of the distal ends of the yokes 26A and 26B of the stator core halves 7A and 7B can have portions which can permanently engage the facing yokes 26A and 26B. The connected stator core halves 7A and 7B would then prevent the yokes 26A and 26B from separating from each other after the bobbin frame 6 is fitted into the casing 2. Since the facing yokes 26A and 26B are in close contact, the magnetic flux paths of the stator are not cut off and therefore the generated torque is not decreased.

In the third embodiment, the spacer 45 shown in FIG. 14 may be provided as a projection formed on the bottom surface of the cover 5. In this case, the centering of the rotor shaft 18 is affected by the interface of the spacer 45 with the bearing 20B.

Therefore, the present examples and preferred embodiments are to be considered as illustrative and not restrictive and the present invention is not to be limited to the details given herein, but may be modified within the scope of the appended claims.

What is claimed is:

1. A rotary actuator comprising:

a stator magnet;

a stator core having at least one excitable magnetic pole and a pair of yokes;

a rotor provided with a rotor magnet;

a bobbin frame including a rotor container, a bobbin portion around which an excitable coil is wound, and a frame mass extending from about the rotor container and to the bobbin portion, said rotor container including a bore for accommodating said rotor and a magnet opening for accommodating said stator magnet to face said rotor magnet, said bobbin portion having a slot for accommodating the excitable magnetic pole of said stator core such that a distal end of the excitable magnetic pole faces said rotor magnet, wherein said pair of yokes of said stator core are located at the sides of said bobbin portions;

said rotor container further including a magnetic pole slot formed integral with the frame mass between said bore and said bobbin portion, said magnetic pole slot being open to said bore and said slot for the excitable magnetic pole; and a magnetic pole piece having a mount in said magnetic pole slot so that said magnetic pole piece is mounted in a position for providing a magnetic field for inducing torque on the rotor magnet, said magnetic pole piece having a first portion adjacent the rotor magnet along an axial direction of said rotor magnet and a second portion for securing a magnetic connection between the magnetic pole piece and the excitable magnetic pole of said stator core, wherein said frame mass maintains said magnetic pole piece in said position during a magnetically induced torque on the rotor.

2. The rotary actuator according to claim 1, wherein the second portion of said magnetic pole piece includes an engaging portion formed thereon for engaging the excitable magnetic pole of said stator core in order to locate said magnetic pole piece at a position where said first surface faces the entire rotor magnet along the axial direction.

3. The rotary actuator according to claim 2, wherein said engaging portion includes an engaging recess.

4. The rotary actuator according to claim 1, wherein said magnetic pole piece is formed by a plurality of laminated magnetic plates.

5. The rotary actuator according to claim 1, wherein said stator core is formed by a plurality of magnetic plates laminated in the axial direction of said rotor magnet, and said magnetic pole piece is formed by a plurality of magnetic plates laminated in a direction orthogonal to the axial direction of said rotor magnet.

6. The rotary actuator according to claim 1, wherein said stator core is formed by a plurality of magnetic plates laminated in the axial direction of said rotor magnet, and said magnetic pole piece includes a plurality of magnetic plates laminated in the axial direction of said rotor magnet.

7. The rotary actuator according to claim 5, wherein the thickness of each of the magnetic plates forming said stator core is equal to the thickness of each of the magnetic plates forming said magnetic pole piece, and the number of the magnetic plates forming said stator core is approximately equal to the number of the magnetic plates forming said magnetic pole piece.

8. The rotary actuator according to claim 1, wherein the first portion of said magnetic pole piece includes a curved surface in accordance with the curvature of a peripheral surface of said rotor magnet.

9. A rotary actuator as claimed in claim 1, wherein said magnetic pole slot extends in the axial direction of said rotor magnet.

10. A rotary actuator as claimed in claim 1, wherein said magnetic pole piece is mounted in said magnetic pole slot through an opening in the bobbin frame, the opening being adjacent an end of the bore.

11. A rotary actuator as claimed in claim 1, wherein said magnetic pole piece is longer in the axial direction than the slot for accommodating the excitable magnetic pole.

12. A rotary actuator comprising:

a first stator magnet;

a second stator magnet;

a first stator core having at least one excitable magnetic pole and a pair of yokes;

a second stator core having at least one excitable magnetic pole and a pair of yokes;

a rotator provided with a rotor magnet;

a bobbin frame including a rotor container, a first bobbin portion around which an excitable coil is wound, and a second bobbin portion around which an excitable coil is wound, and a frame mass extending from about the rotor container and to at least one of the first bobbin portion and the second bobbin portion, said rotor container including a bore for accommodating said rotor, a first magnet opening for accommodating said first stator magnet to face said rotor magnet, and a second magnet opening for accommodating said second stator magnet to face said rotor magnet, said first bobbin portion having a slot for accommodating the excitable magnetic pole of said first stator core such that a distal end of the excitable magnetic pole faces said rotor magnet, said pair of yokes of said first stator core being located at the sides of said first bobbin portion, said second bobbin portion having a slot for accommodating the excitable magnetic pole of said second stator core such that a distal end of the excitable magnetic pole faces said rotor magnet, said pair of yokes of said second stator core being located at the sides of said second bobbin portion;

said rotor container further including a first magnetic pole slot formed between said bore and said first bobbin portion, said first magnetic pole slot being open to said bore and said slot for the excitable magnetic pole of said first stator core, and a second magnetic pole slot formed between said bore and said bobbin portion, said second magnetic pole slot being open to said bore and said slot for the excitable magnetic pole of said second stator core, wherein at least one of said first magnetic pole slot and said second magnetic pole slot is formed integral with the frame mass;

a first magnetic pole piece having a mount in said first magnetic pole slot so that said first magnetic pole piece is mounted in a first position for providing a magnetic field for inducing torque on the rotor magnet, said first magnetic pole piece having a first portion adjacent the rotor magnet along an axial direction of said rotor magnet and a second portion for securing a magnetic connection between said first magnetic pole piece and the excitable magnetic pole of said first stator core; and a second magnetic pole piece having a mount in a second position in said second magnetic pole slot so that said second magnetic pole piece is mounted in a second position for providing a magnetic field for inducing torque on the rotor magnet, said second magnetic pole piece having a first portion adjacent the rotor magnet along the axial direction and a second portion for securing a magnetic connection between said second magnetic pole piece and the excitable magnetic pole of said second stator core;

wherein said frame mass maintains at least one of said first magnetic pole piece in said first position and said second magnetic pole piece in said second position during an induced torque on the rotor.

13. The rotary actuator according to claim 12, wherein the second portion of said first magnetic pole piece includes an engaging portion formed thereon for engaging the excitable magnetic pole of said first stator core in order to locate said first magnetic pole piece at a position where the first portion of said first magnetic pole piece faces the entire rotor magnet along the axial direction.

14. The rotary actuator according to claim 13, wherein the engaging portion of the second portion of said first magnetic pole piece includes an engaging recess.

15. The rotary actuator according to claim 12, wherein the second portion of said second magnetic pole piece includes an engaging portion formed thereon for engaging the excitable magnetic pole of said second stator core in order to locate said second magnetic pole piece at a position where the first portion of said second magnetic pole piece faces the entire rotor magnet along the axial direction.

16. The rotary actuator according to claim 15, wherein the engaging portion of the second portion of said second magnetic pole piece includes an engaging recess.

17. The rotary actuator according to claim 12, wherein said first magnetic pole piece is formed by a plurality of laminated magnetic plates.

18. The rotary actuator according to claim 12, wherein said second magnetic pole piece is formed by a plurality of laminated magnetic plates.

19. The rotary actuator according to claim 12, wherein said first stator core is formed by a plurality of magnetic plates laminated in the axial direction of said rotor magnet, and said first magnetic pole piece is formed by a plurality of magnetic plates laminated in a direction orthogonal to the axial direction of said rotor magnet.

20. The rotary actuator according to claim 12, wherein said second stator core is formed by a plurality of magnetic plates laminated in the axial direction of said rotor magnet, and said second magnetic pole piece is formed by a plurality of magnetic plates laminated in a direction orthogonal to the axial direction of said rotor magnet.

21. The rotary actuator according to claim 12, wherein said first stator core is formed by a plurality of magnetic plates laminated in the axial direction of said rotor magnet, and said first magnetic pole piece includes a plurality of magnetic plates laminated in the axial direction of said rotor magnet.

22. The rotary actuator according to claim 21, wherein the thickness of each of the magnetic plates forming said first stator core is equal to the thickness of each of the magnetic plates forming said first magnetic pole piece, and the number of the magnetic plates forming said first stator core is approximately equal to the number of the magnetic plates forming said first magnetic pole piece.

23. The rotary actuator according to claim 12, wherein said second stator core is formed by a plurality of magnetic plates laminated in the axial direction of said rotor magnet, and said second magnetic pole piece includes a plurality of magnetic plates laminated in the axial direction of said rotor magnet.

24. The rotary actuator according to claim 23, wherein the thickness of each of the magnetic plates forming said second stator core is equal to the thickness of each of the magnetic plates forming said second magnetic pole piece, and the number of the magnetic plates forming said second stator core is approximately equal to the number of the magnetic plates forming said second magnetic pole piece.

25. The rotary actuator according to claim 12, wherein the first surface of said first magnetic pole piece is curved in accordance with the curvature of a peripheral surface of said rotor magnet.

26. The rotary actuator according to claim 12, wherein the first surface of said second magnetic pole piece is curved in accordance with the curvature of a peripheral surface of said rotor magnet.

27. A rotary actuator comprising:

a stator magnet;

a stator core having at least one excitable magnetic pole and a pair of yokes;

a rotor provided with a rotor magnet;

a bobbin frame including a rotor container and a bobbin portion around which an excitable coil is wound, said rotor container including a bore for accommodating said rotor and a magnet opening for accommodating said stator magnet to face said rotor magnet, said bobbin portion having a slot for accommodating the excitable magnetic pole of said stator core such that a distal end of the excitable magnetic pole faces said rotor magnet, wherein said pair of yokes of said stator core are located at the sides of said bobbin portions;

said rotor container further including a magnetic pole slot formed between said bore and said bobbin portion to extend in an axial direction of said rotor magnet, said magnetic pole slot being open to said bore and said slot for the excitable magnetic pole; and a magnetic pole piece mounted in said magnetic pole slot, said magnetic pole piece having a first surface facing the rotor magnet along the axial direction and a second surface for securing a magnetic connection between the magnetic pole piece and the excitable magnetic pole of said stator core;

wherein said stator core is formed by a plurality of magnetic plates laminated in the axial direction of said rotor magnet, and said magnetic pole piece includes a plurality of magnetic plates laminated in the axial direction of said rotor magnet, and wherein said magnetic pole piece further includes resin filling the gaps between the plurality of magnetic plates forming said magnetic pole piece, and said resin is distributed in larger quantity at the side of said second surface so that said magnetic pole piece is sectorially shaped.

28. A rotary actuator comprising:

a first stator magnet;

a second stator magnet;

a first stator core having at least one excitable magnetic pole and a pair of yokes;

a second stator core having at least one excitable magnetic pole and a pair of yokes;

a rotor provided with a rotor magnet;

a bobbin frame including a rotor container, a first bobbin portion around which an excitable coil is wound, and a second bobbin portion around which an excitable coil is wound, said rotor container including a bore for accommodating said rotor, a first magnet opening for accommodating said first stator magnet to face said rotor magnet, and a second magnet opening for accommodating said second stator magnet to face said rotor magnet, said first bobbin portion having a slot for accommodating the excitable magnetic pole of said first stator core such that a distal end of the excitable magnetic pole faces said rotor magnet, said pair of yokes of said first stator core being located at the sides of said first bobbin portion, said second bobbin portion having a slot for accommodating the excitable magnetic pole of said second stator core such that a distal end of the excitable magnetic pole faces said rotor magnet, said pair of yokes of said second stator core being located at the sides of said second bobbin portion;

said rotor container further including a first magnetic pole slot formed between said bore and said first bobbin portion to extend in an axial direction of said rotor magnet, said first magnetic pole slot being open to said bore and said slot for the excitable magnetic pole of said first stator core, and a second magnetic pole slot formed between said bore and said second bobbin portion to extend in an axial direction of said rotor magnet, said second magnetic pole slot being open to said bore and said slot for the excitable magnetic pole of said second stator core;

a first magnetic pole piece mounted in said first magnetic pole slot, said first magnetic pole piece having a first surface facing the rotor magnet along the axial direction and a second surface for securing a magnetic connection between said first magnetic pole piece and the excitable magnetic pole of said first stator core; and a second magnetic pole piece mounted in said second magnetic pole slot, said second magnetic pole piece having a first surface facing the rotor magnet along the axial direction and a second surface for securing a magnetic connection between said second magnetic pole piece and the excitable magnetic pole of said second stator core;

wherein said first stator core is formed by a plurality of magnetic plates laminated in the axial direction of said rotor magnet, and said first magnetic pole piece includes a plurality of magnetic plates laminated in the axial direction of said rotor magnetic, and wherein said first magnetic pole piece further includes resin filling the gaps between the plurality of magnetic plates forming said first magnetic pole piece, and said resin is distributed in larger quantity at the side of the second surface of said first magnetic pole piece so that said first magnetic pole piece is sectorially shaped.

29. A rotary actuator comprising:

a first stator magnet;

a second stator magnet;

a first stator core having at least one excitable magnetic pole and a pair of yokes;

a second stator core having at least one excitable magnetic pole and a pair of yokes;

a rotor provided with a rotor magnet;

a bobbin frame including a rotor container, a first bobbin portion around which an excitable coil is wound, and a second bobbin portion around which an excitable coil is wound, said rotor container including a bore for accommodating said rotor, a first magnet opening for accommodating said first stator magnet to face said rotor magnet, and a second magnet opening for accommodating said second stator magnet to face said rotor magnet, said first bobbin portion having a slot for accommodating the excitable magnetic pole of said first stator core such that a distal end of the excitable magnetic pole faces said rotor magnet, said pair of yokes of said first stator core being located at the sides of said first bobbin portion, said second bobbin portion having a slot for accommodating the excitable magnetic pole of said second stator core such that a distal end of the excitable magnetic pole faces said rotor magnet, said pair of yokes of said second stator core being located at the sides of said second bobbin portion;

said rotor container further including a first magnetic pole slot formed between said bore and said first bobbin portion to extend in an axial direction of said rotor magnet, said first magnetic pole slot being open to said bore and said slot for the excitable magnetic pole of said first stator core, and a second magnetic pole slot formed between said bore and said second bobbin portion to extend in an axial direction of said rotor magnet, said second magnetic pole slot being open to said bore and said slot for the excitable magnetic pole of said second stator core;

a first magnetic pole piece mounted in said first magnetic pole slot, said first magnetic pole piece having a first surface facing the rotor magnet along the axial direction and a second surface for securing a magnetic connection between said first magnetic pole piece and the excitable magnetic pole of said first stator core; and a second magnetic pole piece mounted in said second magnetic pole slot, said second magnetic pole piece having a first surface facing the rotor magnet along the axial direction and a second surface for securing a magnetic connection between said second magnetic pole piece and the excitable magnetic pole of said second stator core;

wherein said second stator core is formed by a plurality of magnetic plates laminated in the axial direction of said rotor magnet, and said second magnetic pole piece includes a plurality of magnetic plates laminated in the axial direction of said rotor magnet, and wherein said second magnetic pole piece further includes resin filling the gaps between the plurality of magnetic plates forming said second magnetic pole piece, and said resin is distributed in larger quantity at the side of the second surface of said second magnetic pole piece so that said second magnetic pole piece is sectorially shaped.

30. A rotary actuator comprising:

a stator magnet;

a stator core having at least one excitable magnetic pole and a pair of yokes;

a rotor provided with a rotor magnet;

a bobbin frame including a rotor container and a bobbin portion around which an excitable coil is wound, said rotor container including a bore for accommodating said rotor and a magnet opening for accommodating said stator magnet to face said rotor magnet, said bobbin portion having a slot for accommodating the excitable magnetic pole of said stator core such that a distal end of the excitable magnetic pole faces said rotor magnet, wherein said pair of yokes of said stator core are located at the sides of said bobbin portions;

said rotor container further including a magnetic pole slot formed integral with said bobbin frame between said bore and said bobbin portion to extend in an axial direction of said rotor magnet, said magnetic pole slot having an interior wall and said magnetic pole slot being open to both said bore and said slot for the excitable magnetic pole; and a magnetic pole piece mounted in a position in said magnetic pole slot, said magnetic pole piece having a first surface facing the rotor magnet along the axial direction and a second surface for securing a magnetic connection between the magnetic pole piece and the excitable magnetic pole of said stator core, wherein said interior wall resists movement of said magnetic pole piece from said position during a magnetically induced torque on the rotor.

31. A rotary actuator comprising:

a stator magnet;

a stator core having at least one excitable magnetic pole and a pair of yokes;

a rotor provided with a rotor magnet;

a bobbin frame including a rotor container and a bobbin portion around which an excitable coil is wound, said rotor container including a bore for accommodating said rotor and a magnet opening for accommodating said stator magnet to face said rotor magnet, said bobbin portion having a slot for accommodating the excitable magnetic pole of said stator core such that a distal end of the excitable magnetic pole faces said rotor magnet, wherein said pair of yokes of said stator core are located at the sides of said bobbin portions;

said rotor container further including a magnetic pole slot formed between said bore and said bobbin portion to extend in an axial direction of said rotor magnet, said magnetic pole slot being open to said bore and said slot for the excitable magnetic pole; and a magnetic pole piece mounted in said magnetic pole slot, said magnetic pole piece having a first surface facing the rotor magnet along the axial direction and a second surface for securing a magnetic connection between the magnetic pole piece and the excitable magnetic pole of said stator core, wherein the excitable magnetic pole engages the accommodating slot separately from the magnetic pole piece engaging said magnetic pole slot.

32. A rotary actuator comprising:

a stator magnet;

a stator core having at least one excitable magnetic pole and a pair of yokes;

a rotor provided with a rotor magnet;

a bobbin frame including a rotor container and a bobbin portion around which an excitable coil is wound, said rotor container including a bore for accommodating said rotor and a magnet opening for accommodating said stator magnet to face said rotor magnet, said bobbin portion having a slot for accommodating the excitable magnetic pole of said stator core such that a distal end of the excitable magnetic pole faces said rotor magnet, wherein said pair of yokes of said stator core are located at the sides of said bobbin portions;

said rotor container further including a magnetic pole slot formed between said bore and said bobbin portion to extend in an axial direction of said rotor magnet, said magnetic pole slot being open to said bore and said slot for the excitable magnetic pole; and a magnetic pole piece mounted in said magnetic pole slot, said magnetic pole piece having a first surface facing the rotor magnet along the axial direction and a second surface for securing a magnetic connection between the magnetic pole piece and the excitable magnetic pole of said stator core, wherein said excitable coil has an extent in the axial direction that is less than or equal to an extent of the magnetic pole piece.

33. A rotary actuator comprising:

a stator magnet;

a stator core having at least one excitable magnetic pole and a pair of yokes;

a rotor provided with a rotor magnet;

a bobbin frame including a rotor container, a bobbin portion around which an excitable coil is wound, said rotor container including a bore for accommodating said rotor and a magnet opening for accommodating said stator magnet to face said rotor magnet, said bobbin portion having a slot for accommodating the excitable magnetic pole of said stator core such that a distal end of the excitable magnetic pole faces said rotor magnet, wherein said pair of yokes of said stator core are located at the sides of said bobbin portions;

said rotor container further including a holder formed between said bore and said bobbin portion; and a magnetic pole piece having a mount on said holder so that said magnetic pole piece is mounted in a position for providing a magnetic field for inducing torque on the rotor magnet, said magnetic pole piece having a first portion adjacent the rotor magnet along an axial direction of said rotor magnet and a second portion for securing a magnetic connection between the magnetic pole piece and the excitable magnetic pole of said stator core, wherein said holder maintains said magnetic pole piece in said position during a magnetically induced torque on the rotor.

* * * * *